US007338738B2

(12) United States Patent
Kojima et al.

(10) Patent No.: US 7,338,738 B2
(45) Date of Patent: Mar. 4, 2008

(54) ELECTROPHOTOGRAPHIC PHOTOSENSITIVE MEMBER AND PROCESS FOR PRODUCING THE SAME

(75) Inventors: Satoshi Kojima, Shizuoka (JP); Kazuhiko Takada, Shizuoka (JP); Hironori Ohwaki, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 294 days.

(21) Appl. No.: 10/733,568

(22) Filed: Dec. 12, 2003

(65) Prior Publication Data

US 2004/0121250 A1 Jun. 24, 2004

(30) Foreign Application Priority Data

Dec. 12, 2002 (JP) ..... 2002-361151

(51) Int. Cl.
*G03G 5/043* (2006.01)
*G03G 5/08* (2006.01)

(52) U.S. Cl. ..... 430/57.4; 430/128

(58) Field of Classification Search ..... 430/57.4, 430/57.5, 57.6, 57.7, 65, 66, 128, 131, 132, 430/133, 56, 127

See application file for complete search history.

(56) References Cited

U.S. PATENT DOCUMENTS

| | | | | |
|---|---|---|---|---|
| 4,265,991 | A | 5/1981 | Hirai et al. | 430/64 |
| 5,512,510 | A * | 4/1996 | Murayama et al. | 427/569 |
| 5,849,455 | A * | 12/1998 | Ueda et al. | 430/128 |
| 6,090,513 | A | 7/2000 | Niino et al. | 430/65 |
| 6,391,394 | B1 | 5/2002 | Shirasuna et al. | 427/569 |
| 6,531,253 | B2 | 3/2003 | Ehara et al. | 430/66 |
| 6,534,228 | B2 | 3/2003 | Kawada et al. | 430/66 |
| 7,033,717 | B2 * | 4/2006 | Kojima et al. | 430/66 |
| 7,033,721 | B2 * | 4/2006 | Hashizume et al. | 430/128 |
| 2002/0018949 | A1 * | 2/2002 | Ehara et al. | 430/66 |
| 2002/0168859 | A1 | 11/2002 | Ehara et al. | 438/694 |

* cited by examiner

*Primary Examiner*—Janis L. Dote
(74) *Attorney, Agent, or Firm*—Fitzpatrick, Cella, Harper & Scinto

(57) ABSTRACT

In an electrophotographic photosensitive member having a support at least the surface of which is conductive, and a photoconductive layer formed thereon containing an amorphous material composed chiefly of silicon, the photoconductive layer has two or more layer regions, and protuberances in a layer region adjoining to a layer region that is closest to the free surface of the electrophotographic photosensitive member have been stopped from growing at the surface of that layer region in which the protuberances occur. The protuberances has been stopped from growing not to become so large as to appear as image defects on images. Also disclosed is a process for producing such an electrophotographic photosensitive member.

14 Claims, 6 Drawing Sheets

ELECTROPHOTOGRAPHIC PHOTOSENSITIVE MEMBER AND PROCESS FOR PRODUCING THE SAME

BACKGROUND OF THE INVENTION

1. Field of the Invention

This invention relates to an electrophotographic photosensitive member which can reduce image defects, has a high charging performance and can form good high-density images over a long period of time, and to a process for producing such an electrophotographic photosensitive member.

2. Related Background Art

Materials that form photoconductive layers in solid-state image pick-up devices or in electrophotographic light-receiving members in the field of image formation or in character readers are required to have properties as follows: They are highly sensitive, have a high SN ratio [photocurrent (Ip)/dark current (Id)], have absorption spectra suited to spectral characteristics of electromagnetic waves to be radiated, have a high response to light, have the desired dark resistance and are harmless to human bodies when used; and also, in the solid-state image pick-up devices, the materials are required to have properties that enable afterimages to be erased in a prescribed time. In particular, in the case of electrophotographic photosensitive members of electrophotographic apparatus used as business machines in offices, it is important that they are safe to use.

Materials that generate interest from such a viewpoint include amorphous silicon (hereinafter "a-Si") whose dangling bonds have been modified with monovalent elements such as hydrogen or halogen atoms, and its application to electrophotographic photosensitive members is disclosed in, e.g., U.S. Pat. No. 4,265,991.

Many processes by which electrophotographic photosensitive members comprised of a-Si are formed on conductive supports, are known in the art, as exemplified by sputtering, a process in which source gases are decomposed by heat (thermal CVD), a process in which source gases are decomposed by light (photo-assisted CVD) and a process in which source gases are decomposed by plasma (plasma-assisted CVD). In particular, one having been put into practical use in a very advanced state at present is plasma-assisted CVD (chemical vapor deposition), i.e., a process in which source gases are decomposed by direct-current or high-frequency or microwave glow discharge to form deposited films on the conductive support.

For example, as the layer construction of such deposited films, there are proposed those in which a "surface layer" or an "upper-part blocking layer" having blocking power is further provided on the surface side, in addition to electrophotographic photosensitive members composed chiefly of a-Si and modification elements added appropriately, as conventionally practiced. For example, U.S. Pat. No. 6,090,513 discloses an electrophotographic photosensitive member provided between a photoconductive layer and a surface layer an intermediate layer (upper-part blocking layer) having carbon atoms in a smaller content than the surface layer and incorporated with atoms capable of controlling conductivity.

Such conventional processes for producing electrophotographic photosensitive members have made it possible to obtain electrophotographic photosensitive members having characteristics and uniformity which are practical to a certain extent. Strict cleaning of the interiors of vacuum reactors also makes it possible to obtain electrophotographic photosensitive members reducing defects to a certain extent. However, with such conventional processes for producing electrophotographic photosensitive members, there is an unsolved problem in that, for products in which large-area and relatively thick deposited films are required as in electrophotographic photosensitive members, it is difficult, e.g., to obtain in a high yield deposited films that have uniform film quality, can satisfy requirements for various optical and electrical properties and also can reduce image defects when images are formed by an electrophotographic process.

In particular, a-Si films have a disposition that, where any nuclei-forming matters such as dust in the order of micrometers have adhered to the support surface or deposited-film surface, the dust serves as nuclei during deposition to cause the growth of "protuberances". FIG. 2 is a diagrammatic sectional view showing an example of such protuberances of a conventional electrophotographic photosensitive member. The photosensitive member shown therein is constituted of a support 201 having a conductive surface, and a photoconductive layer 202 and a surface layer 203 superposingly formed thereon. Inclusion of dust 204 in the course of forming this photoconductive layer 202 causes abnormal growth on the dust that serves as nuclei during the deposition of a film. Such protuberances 205 have the shape of reversed cones whose vertexes start from the nuclei, and have a disposition that they have a lower ability to retain electric charges than the normal area.

Hence, some part of the protuberances appears in the form of white dots in solid black images on images formed (in the case of reverse development, appears in the form of black dots in solid white images). This image defect called "dots" is put to severer standards year by year. Where electrophotographic photosensitive members are set in color copying machines, the standards come much severer. In order to lessen such nuclei of protuberances, supports to be used are strictly cleaned before deposition, where the steps of setting the supports in a reactor are all operated in a clean room or in vacuo. In this way, efforts have been made so as to lessen as far as possible the dust which may adhere to the support surface before the deposition is started, thus the desired effects have been obtained. However, the cause of the occurrence of protuberances is not limited to the dust having adhered to the support surface. That is, where a-Si electrophotographic photosensitive members are produced, the layer thickness required is as large as several micrometers to tens of micrometers, and hence the deposition time reaches several hours to tens of hours. During such deposition, the deposited film of the a-Si and powdery polysilane is deposited not only on the supports but also on inner walls of the reactor and structures inside the reactor.

These reactor inner walls and structures do not have any surfaces that have been controlled like the supports. Hence, depositions may weakly adhere to come off in some cases during deposition carried out over a long time. Once even slight depositions come off during deposition, they cause dust, and the dust adheres to the surfaces of photosensitive members under deposition, so that the abnormal growth takes place starting from the dust to cause protuberances. Accordingly, in order to maintain a high yield, careful control is required not only for supports before deposition but also for preventing depositions from coming off in the reactor during the deposition. This has made it difficult to produce the a-Si photosensitive members.

SUMMARY OF THE INVENTION

An object of the present invention is to provide an electrophotographic photosensitive member that can overcome the above various problems in conventional electrophotographic photosensitive members without losing any electrical properties, can be produced stably and in a good yield, can reduce image defects, can ensure high image quality and is easy to handle, and to provide a process for producing such an electrophotographic photosensitive member.

Stated specifically, the present invention provides an electrophotographic photosensitive member comprising a support at least the surface of which is conductive, and a photoconductive layer formed thereon containing an amorphous material composed chiefly of silicon, wherein;

the photoconductive layer has two or more layer regions, and protuberances in a layer region (A) adjoining to a layer region (B) that is closest to the free surface of the electrophotographic photosensitive member have been stopped from growing at the surface of the layer region (A).

The present invention also provides a process for producing an electrophotographic photosensitive member having a support at least the surface of which is conductive, and a photoconductive layer formed thereon containing an amorphous material composed chiefly of silicon, which comprises forming a layer region (A) in the photoconductive layer, carrying out an operation for stopping protuberances from growing at the surface of the layer region (A), and forming a layer region (B) on the layer region (A), wherein;

said photoconductive layer has two or more layer regions, and protuberances in the layer region (A) adjoining to the layer region (B) that is closest to a free surface of the electrophotographic photosensitive member have been stopped from growing at the surface of the layer region (A).

DETAILED DESCRIPTION OF THE PREFERRED EMBODIMENTS

The present inventors have repeated extensive studies in order to solve the above problems. As a result, they have discovered that an electrophotographic photosensitive member having vastly remedied image defects such as dots without adversely affecting any electrical properties can stably be produced by producing the electrophotographic photosensitive member in the following way, and have accomplished the present invention.

In the present invention, in the course of forming a photoconductive layer, deposition is restarted after the system is brought into a condition where the dust causative of dots has been reduced, to make the electrophotographic photosensitive member have a region where protuberances caused by abnormal growth have stopped growing in the layer thickness direction. As a process for producing such an electrophotographic photosensitive member, it is preferable that, e.g., the deposition to form the photoconductive layer is stopped, where a conductive support on which the photoconductive layer has partly been deposited as a layer region is taken out of a reactor and is moved to a clean reactor to restart deposition therein. It is further preferable that, when the conductive support on which such a photoconductive layer region has been deposited is taken out of the reactor, it is taken out into a vacuum atmosphere. Also, the photoconductive layer region deposited at each time should be in a small thickness or the deposition time therefor should be short. This is better in order to reduce the films and powdery polysilane deposited on the inner walls of the reactor and on the structures inside the reactor, so that dust scattering is lessened and image defects are greatly reduced.

The present invention has been accomplished as a result of the following studies.

From the results of observation of image defects and the size and sections of protuberances, the present inventors have found that any protuberances which have once begun to grow do not become causative of image defects before they grow to a certain size. They have also confirmed that such small protuberances at the initial stage of growth which are not causative of image defects do not continue to grow any longer when deposition is discontinously carried out, and are stopped from growing not to become large protuberances.

Figure 1:
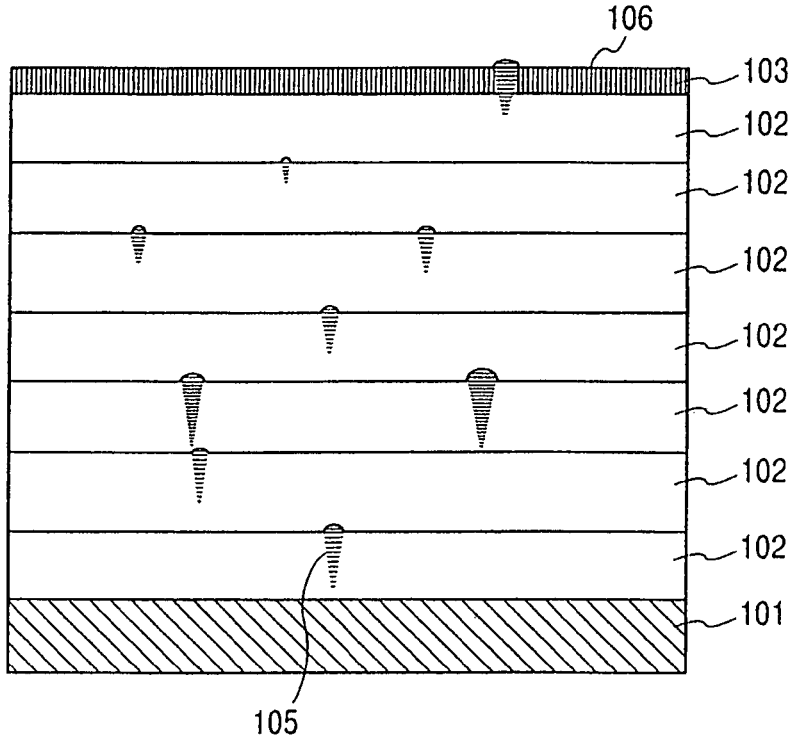
FIG. 1 is a diagrammatic sectional view showing an example of protuberances in the electrophotographic photosensitive member of the present invention.
Figure 2:
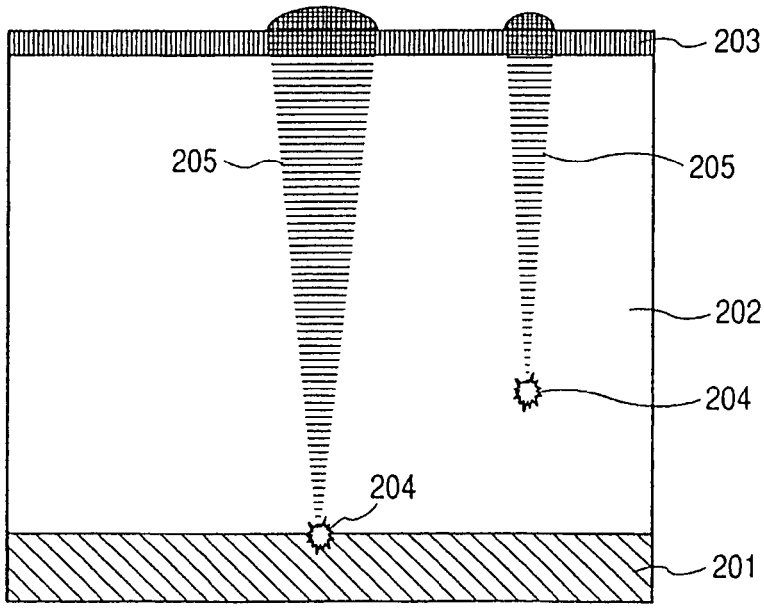
FIG. 2 (PRIOR ART)
FIG. 2 is a diagrammatic sectional view showing an example of protuberances in a conventional electrophotographic photosensitive member.

FIG. 1 is a diagrammatic sectional view showing an example of protuberances of the electrophotographic photosensitive member of the present invention. This photosensitive member is constituted of a support 101 having a conductive surface, and a photoconductive layer and a surface layer 103 in this order formed thereon; the photoconductive layer being formed by superposing photoconductive layer regions 102. Reference numeral 106 denotes a free surface. Then, an operation for stopping the growth of protuberances in the course of forming the photoconductive layer is carried out to form a photoconductive layer having portions where the protuberances have stopped growing at the surface of each photoconductive layer region. Here, the surfaces of the protuberances are included in the surfaces of photoconductive layer regions. The protuberances 105 produced by depositing each photoconductive layer region no longer continue to grow as a result of this operation, so that protuberances appearing on the surface of the electrophotographic photosensitive member can be small.

The present inventors have observed the surfaces of protuberances in detail to find that the difference between small protuberances and normal portions at the outermost surface of the electrophotographic photosensitive member is small (i.e., small raises in the shape of convexes or domes) in such an extent that there is slight swell. In the observation of protuberances having grown largely, it have been found that the difference between large protuberances and normal portions at the outermost surface of the electrophotographic photosensitive member (i.e., large raises in the shape of convexes or domes) is large, and many of them have been found to distinctively rise from the boundaries between the protuberances and the normal portions.

The present invention is described below in detail with reference to the drawings as needed.

a-Si Photosensitive Member

Figure 3:
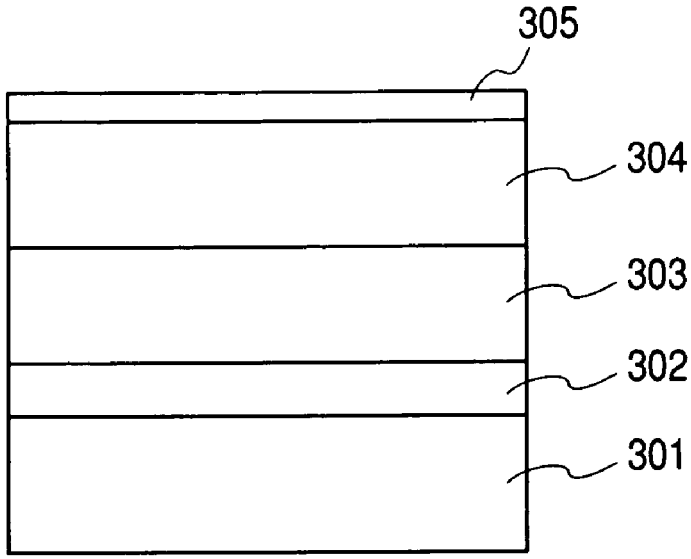
FIG. 3 is a diagrammatic sectional view showing an example of the layer construction of the electrophotographic photosensitive member of the present invention.

FIG. 3 shows an example of the layer construction of the electrophotographic photosensitive member of the present invention. The electrophotographic photosensitive member of the present invention can be produced, for example, as follows: in a first reactor, layers are deposited up to a photoconductive layer region 303 on a support 301 made of a conductive material as exemplified by aluminum or stainless steel, then the support having the layers deposited thereon is taken out of the first reactor and moved to a second reactor, and a photoconductive layer region 304 is further deposited thereon, and the support with the layers thus deposited is moved one after another to a different new reactor to undergo the deposition of another photoconductive layer region until the photoconductive layer comes to have a stated layer thickness. By producing the electrophotographic photosensitive member through that process, the layer regions can be deposited in a way that protuberances having grown from the support surface and protuberances having grown in the course of deposition are halfway stopped from further growing while being left small, and do not appear as image defects, making it possible to keep good image quality.

Such an operation may be carried out by, e,g., taking the support having each photoconductive layer region deposited thereon out of the reactor into a vacuum atmosphere. This operation is carried out preferably while the thickness of each photoconductive layer region comes to be 3 μm or more and 15 μm or less from the support side (of each layer region).

Stated more specifically, for example, in order to take the support out of the reactor into a vacuum atmosphere, it is preferable that a support-loading chamber, a support-heating chamber, a reaction chamber (reactor), a support-cooling and -delivery chamber are each composed of a vacuum chamber, and a transporting vacuum chamber is moved between the support-loading chamber and the other chambers, and connected with each of the support-loading chamber and the other chambers via their open-close gates, so that the support is taken in and out of, and moved between, the transporting vacuum chamber and the support-loading chamber and the other chambers, where;

a photoconductive layer region containing an amorphous material composed chiefly of silicon is formed on the support set in the reaction chamber, and then the support on which the photoconductive layer region has been deposited is transported to, and set in, a different reaction chamber by means of the transporting vacuum chamber to repeat deposition of a photoconductive layer region containing an amorphous material composed chiefly of silicon, to form the photoconductive layer.

Further, it is preferable that the transporting vacuum chamber is so provided that a transporting vacuum chamber which transports the support from the support-loading chamber to the reaction chamber, a transporting vacuum chamber which transports the support (with a photoconductive layer region) from the reaction chamber to the same or different reaction chamber, and a transporting vacuum chamber which transports the support (with photoconductive layer regions) from the reaction chamber to the support-delivery chamber are independent of one another. It is also preferable that the support on which a photoconductive layer region has been deposited is transported to a reaction chamber whose inner surfaces have been cleaned, and the next photoconductive layer region is superposingly formed thereon. It is still also preferable that the operation for stopping the growth of protuberances is conducted by superposingly forming a photoconductive layer region after the surface of a photoconductive layer region previously deposited has been treated with hydrogen plasma.

In the present invention, a-Si is usually used as a material of the photoconductive layer.

A surface layer 305 may optionally be provided. As the surface layer 305 used is a layer composed chiefly of a-Si and optionally containing at least one of carbon, nitrogen and oxygen in a relatively large quantity. This layer can improve environmental resistance, wear resistance and scratch resistance.

A lower-part blocking layer 302 may optionally be provided. The lower-part blocking layer 302 is formed and doped with a dopant such as an element belonging to Group 13 of the periodic table (hereinafter Group 13 element) or an element belonging to Group 15 of the periodic table (hereinafter Group 15 element), thereby making it possible to control its charge polarity such as positive charging or negative charging.

Figure 4:
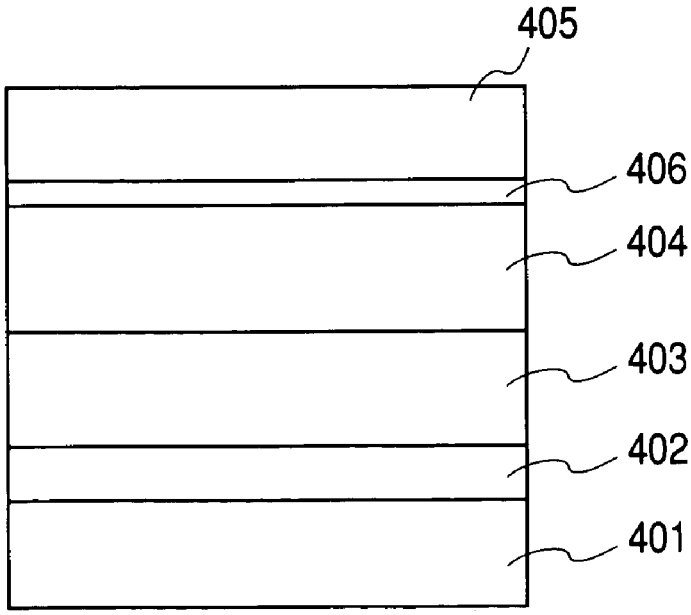
FIG. 4 is a diagrammatic sectional view showing another example of the layer construction of the electrophotographic photosensitive member of the present invention.

As shown in FIG. 4, an upper-part blocking layer 406 may optionally further provided. In FIG. 4, reference numerals 401 to 405 denote the same as those denoted by 301 to 305 in FIG. 3. The upper-part blocking layer is composed chiefly of a-Si and optionally contains at least one of carbon, nitrogen and oxygen.

Shape and Material of Support

The support 301 may have any desired shapes according to how to drive the electrophotographic photosensitive member. For example, it may be in the shape of a cylinder or a sheet-like endless belt having smooth surface or uneven surface. Its thickness may appropriately be determined so that the electrophotographic photosensitive member can be formed as desired. Where a flexibility is required as electrophotographic photosensitive members, the support may be made as thin as possible as long as it can sufficiently function as the support. In view of production and handling and from the viewpoint of mechanical strength, however, the support may normally have a wall thickness of 10 μm or more.

As materials for the support, conductive materials such as aluminum and stainless steel as mentioned above are commonly used. Also usable are, e.g., materials having no conductivity, such as plastic and glass of various types, provided with conductivity by vacuum deposition or the like of a conductive material on their surfaces at least on the side where the photoconductive layer is formed.

The conductive material may include, besides the foregoing, metals such as Cr, Mo, Au, In, Nb, Te, V, Ti, Pt, Pd and Fe, and alloys of any of these.

The plastic may include films or sheets of polyester, polyethylene, polycarbonate, cellulose acetate, polypropylene, polyvinyl chloride, polystyrene or polyamide.

Photoconductive Layer

The photoconductive layer regions 303 and 304 included in the photoconductive layer is constituted of an amorphous material which is composed chiefly of silicon atoms and normally contains hydrogen atoms and/or halogen atoms ("a-Si(H,X)").

The a-Si(H,X) deposited film may be formed by plasma-assisted CVD, sputtering or ion plating. Deposited films prepared by the plasma-assisted CVD are preferred because deposited films having especially high quality can be obtained.

In particular, the photoconductive layer is required to have the largest layer thickness in the electrophotographic photosensitive member and also to have a uniform film quality. When depositing this photoconductive layer, the protuberances causative of image defects are liable to grow. Accordingly, it is preferable to stop the growth of protuberances before the protuberances caused by the dust having adhered to the support surface come to have a size as large as 10 μm. In addition, it is preferable to carry out the operation to stop their growth, before depositions on the reactor inner walls drop off.

In view of the above factors, the operation to stop the growth of protuberances may preferably be carried out before the thickness of a photoconductive layer region deposited at each time comes to be 15 μm at the maximum.

The smaller the thickness of the deposited film is or the shorter the deposition time is, the smaller the size of the protuberances is and the smaller the quantity of the deposition on reactor inner walls is. In order for the electrophotographic photosensitive member to function as such, the operation to stop the growth of protuberances may preferably be carried out after the thickness of a photoconductive layer region deposited at each time has come to be 3 μm or more at the minimum. This is preferable taking account of the layer thickness that is usually required to be 10 μm or more at the minimum, and the cost that may increase with extension of production time as a result of repetition of the operation.

As materials for the a-Si(H,X) film, gaseous or gasifiable silicon hydrides (silanes) such as $SiH_4$ $Si_2H_6$, $Si_3H_8$ and $Si_4H_{10}$ may be used as source gases, any of which may be decomposed by means of a high-frequency power to form the film. In view of the easiness of handling in layer formation and Si-feeding efficiency, $SiH_4$ and $Si_2H_6$ are preferred.

Here, the support temperature may preferably be kept at a temperature of approximately from 200° C. to 450° C., and more preferably from 250° C. to 350° C., in view of characteristics. This is to accelerate the surface reaction at the support surface to sufficiently effect structural relaxation.

The pressure inside the reactor is appropriately selected within an optimum range in accordance with layer designing. In usual cases, it may be set at from $1\times10^{-2}$ Pa to $1\times10^{3}$ Pa, and preferably from $5\times10^{-2}$ Pa to $5\times10^{2}$ Pa, and most preferably from $1\times10^{-1}$ Pa to $1\times10^{2}$ Pa.

In any of these gases, hydrogen gas ($H_2$) or a gas containing halogen atoms may further be mixed in a desired quantity to form the film. This is preferred in order to improve characteristics. Useful source gases for feeding halogen atoms may include fluorine gas ($F_2$) and interhalogen compounds such as BrF, ClF, $ClF_3$, $BrF_3$, $BrF_5$, $IF_5$ and $IF_7$. It may also include silicon compounds containing halogen atoms, what is called silane derivatives substituted with halogen atoms, specifically silicon fluorides such as $SiF_4$ and $Si_2F_6$, as preferred ones. Also, any of these source gases for feeding halogen atoms may optionally be diluted with a gas such as $H_2$, He, Ar or Ne when used.

There are no particular limitations on the whole layer thickness of the photoconductive layer. It may suitably be from about 10 μm to 60 μm taking account of the production cost and so forth.

The layer regions 303 and 304 may also be formed in more multiple layer region construction in order to improve characteristics. For example, photosensitivity and charge characteristics can simultaneously be improved by disposing on the surface side a layer region having a narrower band gap and on the support side a layer region having a broader band gap. Such a device of layer construction brings about a dramatic effect especially in respect of light sources having a relatively long wavelength and also having almost no scattering in wavelength as in the case of semiconductor lasers.

Lower-Part Blocking Layer

In the electrophotographic photosensitive member of the present invention, the lower-part blocking layer 302, which is optionally provided, may commonly be formed of a-Si (H,X) as a base and may be incorporated with a dopant such as an element belonging to Group 13 or Group 15 of the periodic table. This makes it possible to control its conductivity type and to provide the layer with the ability to block carriers from being injected from the support. In this case, at least one element selected from carbon (C), nitrogen (N) and oxygen (O) may optionally be incorporated so that the stress can be regulated and the function to improve adherence of the photosensitive layer can be provided.

In the lower-part blocking layer, the Group 13 element serving as the dopant may specifically include boron (B), aluminum (Al), gallium (Ga), indium (In) and thallium (Tl). In particular, B and Al are preferred. The Group 15 element may specifically include phosphorus (P), arsenic (As), antimony (Sb) and bismuth (Bi). In particular, P is preferred.

Source materials for incorporating such a Group 13 element may specifically include, as a material for incorporating boron atoms, boron hydrides such as $B_2H_6$, $B_4H_{10}$, $B_5H_9$, $B_5H_{11}$, $B_6H_{10}$, $B_6H_{12}$ and $B_6H_{14}$ and boron halides such as $BF_3$, $BCl_3$ and $BBr_3$. Besides, the material may also include $AlCl_3$, $GaCl_3$, $Ga(CH_3)_3$, $InCl_3$ and $TlCl_3$. In particular, $B_2H_6$ is one of preferred source materials from the viewpoint of handling.

Useful materials for incorporating the Group 15 element may include, as a material for incorporating phosphorus atoms, phosphorus hydrides such as $PH_3$ and $P_2H_4$ and phosphorus halides such as $PF_3$, $PF_5$, $PCl_3$, $PCl_5$, $PBr_3$ and $PI_3$. It may further include $PH_4I$. Besides, the starting material for incorporating the Group 15 element may also include, as those which are effective, $AsH_3$, $AsF_3$, $AsCl_3$, $AsBr_3$, $AsF_3$, $SbH_3$, $SbF_3$, $SbF_5$, $SbCl_3$, $SbCl_5$, $BiH_3$, $BiCl_3$ and $BiBr_3$.

The dopant atoms may preferably be in a content of from $1\times10^{-2}$ to $1\times10^{4}$ atomic ppm, more preferably from $5\times10^{-2}$ to $5\times10^{3}$ atomic ppm, and most preferably from $1\times10^{-1}$ to $1\times10^{3}$ atomic ppm.

Upper-Part Blocking Layer

In the electrophotographic photosensitive member of the present invention, the upper-part blocking layer 406, which is optionally provided at the upper part of the photoconductive layer, has the function to block electric charges from being injected from the surface side to the photoconductive layer side when the photosensitive member is charged in a certain polarity on its free surface, and exhibits no such function when charged in a reverse polarity. In order to provide such function, it is necessary for the upper-part blocking layer 406 to be properly incorporated with impurity atoms capable of controlling conductivity. As the impurity atoms used for such a purpose, an element belonging to Group 13 of the periodic table or an element belonging to Group 15 of the periodic table may be used in the present invention. The Group 13 element may specifically include boron (B), aluminum (Al), gallium (Ga), indium (In) and thallium (Tl). In particular, boron is preferred. The Group 15 element may specifically include phosphorus (P), arsenic (As), antimony (Sb) and bismuth (Bi). In particular, phosphorus (P) is preferred.

The content of the impurity atoms capable of controlling conductivity which are to be incorporated in the upper-part blocking layer 406 depends on the composition of the upper-part blocking layer 406 and the manner of production, and can not sweepingly be defined. In general, such impurity atoms may preferably be in a content of from 100 atomic ppm or more to 30,000 atomic ppm or less, and more preferably from 500 atomic ppm or more to 10,000 atomic ppm or less.

The atoms capable of controlling the conductivity which are contained in the upper-part blocking layer 406 may uniformly be distributed all over the upper-part blocking layer 406, or may be contained in a state that they are distributed non-uniformly in the layer thickness direction. In any case, however, in the in-plane direction parallel to the surface of the support, it is necessary for such atoms to be evenly contained in a uniform distribution all over the layer so that the properties in the in-plane direction can be rendered uniform.

The upper-part blocking layer 406 may be formed using any materials so long as they are a-Si materials, and may preferably be constituted of the same material as the surface layer 405. More specifically, preferably usable are "a-SiC:H,X" (amorphous silicon containing a hydrogen atom (H) and/or a halogen atom (X) and further containing a carbon atom), "a-SiO:H,X" (amorphous silicon containing a hydrogen atom (H) and/or a halogen atom (X) and further containing an oxygen atom), "a-SiN:H,X" (amorphous silicon containing a hydrogen atom (H) and/or a halogen atom (X) and further containing a nitrogen atom), and "a-SiCON:H,X" (amorphous silicon containing a hydrogen atom (H) and/or a halogen atom (X) and further containing at least one of a carbon atom, an oxygen atom and a nitrogen atom). The carbon atoms or nitrogen atoms or oxygen atoms contained in the upper-part blocking layer 406 may uniformly be distributed all over that layer, or may be contained in such a state that they are distributed non-uniformly in the layer thickness direction. In any case, however, in the in-plane direction parallel to the surface of the support, it is necessary for such atoms to be evenly contained in a uniform distribution all over the layer so that the properties in the in-plane direction can also be made uniform.

The content of the carbon atoms and/or nitrogen atoms and/or oxygen atoms to be incorporated in the whole layer region of the upper-part blocking layer 406 may appropriately be so determined that the object of the present invention can effectively be achieved. It may preferably be in the range of from 10% to 70% based on the total sum of silicon atoms, where the total sum is the amount of one kind when one kind is incorporated, and is the total amount of two or more kinds when two or more kinds are incorporated.

In the present invention, usually the upper-part blocking layer 406 is required to be incorporated with hydrogen atoms and/or halogen atoms. This is effective for compensating unused valences of silicon atoms and improving layer quality, in particular, improving photoconductivity and charge retentivity. The hydrogen atoms may usually be in a content of from 30 to 70 atomic %, preferably from 35 to 65 atomic %, and more preferably from 40 to 60 atomic %, based on the total amount of constituent atoms. The halogen atoms may usually be in a content of from 0.01 to 15 atomic %, preferably from 0.1 to 10 atomic %, and more preferably from 0.5 to 5 atomic %.

Further, it is preferable for the upper-part blocking layer 406 to be continuously changed in its composition from the photoconductive layer region 404 side toward the surface layer 405. This is effective not only in improving the adherence but also in preventing the interference.

In order to form an upper-part blocking layer 406 having characteristics that can achieve the object of the present invention, it is necessary to appropriately set the mixing ratio of the Si-feeding gas to the C- and/or N- and/or O-feeding gas(es), the gas pressure inside the reactors, the discharge power and the support temperature.

The pressure inside the reactor may appropriately be selected within an optimum range in accordance with layer designing. In usual cases, it may be set at from $1\times10^{-2}$ Pa to $1\times10^{3}$ Pa, and preferably from $5\times10^{-2}$ Pa to $5\times10^{2}$ Pa, and most preferably from $1\times10^{-1}$ Pa to $1\times10^{2}$ Pa.

The temperature of the support is also appropriately selected within an optimum range in accordance with layer designing. In usual cases, the temperature may preferably be set at from 150° C. to 350° C., more preferably from 180° C. to 330° C., and most preferably from 200° C. to 300° C.

In the present invention, desirable numerical ranges of the dilute-gas mixing ratio, gas pressure, discharge power and support temperature for forming the upper-part blocking layer 406 may include the ranges given above. These film formation factors are by no means independently separately determined in usual cases. Optimum values of factors for forming the layer should be determined on the basis of the relative and systematic relationship so that photosensitive members having the desired characteristics can be formed.

Surface Layer

In the electrophotographic photosensitive member of the present invention, the surface layer 305, which is optionally provided at the outermost surface, has a free surface and is effective in improvement chiefly in moisture resistance, performance on continuous repeated use, electrical breakdown strength, service environmental properties and extensive operation performance (running performance).

Including the a-Si type surface layer 305, the amorphous materials that form the photoconductive layer regions 303 and 304 and the surface layer 305 each have a common constituent, silicon atoms, and hence a chemical stability is fully ensured at the interface between layers. Where an a-Si type material is used as a material for the surface layer 305, preferred is a compound with silicon atoms which contains at least one element selected from carbon, nitrogen and oxygen. In particular, one composed chiefly of a-SiC is preferred.

Where the surface layer 305 contains at least one of carbon, nitrogen and oxygen, any of these atoms may preferably be in a content ranging from 30% to 95% based on all the atoms constituting a network.

Usually, the surface layer 305 is required to be incorporated with hydrogen atoms and/or fluorine atoms. This is to compensate unused valences of silicon atoms, and to improve layer quality, in particular, to improve photoconductivity and charge retentivity. The hydrogen atoms may usually be in a content of from 30 to 70 atomic %, preferably from 35 to 65 atomic %, and most preferably from 40 to 60 atomic %, based on the total amount of constituent atoms. The fluorine atoms may usually be in a content of from 0.01 to 15 atomic %, preferably from 0.1 to 10 atomic %, and more preferably from 0.5 to 5 atomic %.

The photosensitive member so formed as to have the hydrogen content and/or fluorine content within these ranges is satisfactorily applicable as a product remarkably superior in its practical use. More specifically, any defects or imperfections (composed chiefly of dangling bonds of silicon atoms or carbon atoms) present inside the surface layer 305 are known to have adverse influence on the properties required for electrophotographic photosensitive members. For example, charge characteristics may deteriorate because of the injection of electric charges from the free surface; charge characteristics may vary because of changes in surface structure in a service environment, e.g., in an environment of high humidity; and the injection of electric charges into the surface layer from the photoconductive layer at the time of corona charging or irradiation with light may cause a phenomenon of afterimages during repeated use because of entrapment of electric charges in the defects inside the surface layer. These are referred to as adverse influence.

However, by controlling the hydrogen content in the surface layer 305 so as to be 30 atomic % or more, the defects inside the surface layer 305 can be greatly reduced, so that compared with conventional cases, improvements can be achieved in respect of electrical properties and high-speed continuous-use performance.

On the other hand, if the hydrogen content in the surface layer 305 is more than 70 atomic %, the hardness of the surface layer 305 may lower, and hence the layer may come not to endure the repeated use. Thus, the controlling of the hydrogen content in the surface layer 305 within the range set forth above is one of very important factors for obtaining superior electrophotographic performance as desired. The hydrogen content in the surface layer 305 can be controlled according to the flow rate of source gases, the ratio of dilute gas to source gas, the support temperature, the discharge power, the gas pressure and so forth.

The controlling of the fluorine atom content in the surface layer 305 so as to be within the range of 0.01 atomic % or more makes it possible to more effectively generate the bonds between silicon atoms and carbon atoms in the surface layer 305. As a function of the fluorine atoms in the surface layer 305, it is possible to effectively prevent the bonds between silicon atoms and carbon atoms from breaking because of damage caused by coronas or the like.

On the other hand, if the fluorine atom content in the surface layer 305 is more than 15 atomic %, it comes almost ineffective to generate the bonds between silicon atoms and carbon atoms in the surface layer 305 and to prevent the bonds between silicon atoms and carbon atoms from breaking because of damage caused by coronas or the like. Moreover, residual potential and image memory come to remarkably appear because the excessive fluorine atoms inhibit the mobility of carriers in the surface layer. Thus, the controlling of fluorine content in the surface layer 305 within the range set forth above is one of important factors for obtaining the desired electrophotographic performance. The fluorine content in the surface layer 305, as with the hydrogen content, may be controlled according to the flow rate of source gases containing fluorine atoms, the support temperature, the discharge power, the gas pressure and so forth.

The surface layer 305 is optionally incorporated with atoms capable of controlling its conductivity. The atoms capable of controlling the conductivity may be contained in such a state as uniformly distributed all over the surface layer 305, or may be contained partly in a state that they are distributed non-uniformly in the layer thickness direction.

The atoms capable of controlling the conductivity may include what is called impurities in the field of semiconductors, and atoms belonging to Group 13 or Group 15 of the periodic table can be used.

The surface layer 305 may usually be formed in a thickness of from 0.01 to 3 μm, preferably from 0.05 to 2 μm, and most preferably from 0.1 to 1 μm. If the layer thickness is smaller than 0.01 μm, the surface layer 305 may become lost because of friction or the like during the use of the photosensitive member. If it is larger than 3 μm, electrophotographic performance may be lowered due to an increase in residual potential.

To form a surface layer 305 having properties that can achieve the object of the present invention, the support temperature and the gas pressure inside the reactor must appropriately be set as needed. The support temperature may appropriately be selected within an optimum range in accordance with layer designing. In usual cases, the temperature may preferably be set at from 150° C. to 350° C., more preferably from 180° C. to 330° C., and most preferably from 200° C. to 300° C.

The pressure inside the reactor may also appropriately be selected within an optimum range likewise in accordance with layer designing. In usual cases, it may be set at from $1\times10^{-2}$ Pa to $1\times10^{3}$ Pa, and preferably from $5\times10^{-2}$ Pa to $5\times10^{2}$ Pa, and most preferably from $1\times10^{-1}$ Pa to $1\times10^{2}$ Pa.

In the present invention, desirable numerical ranges of the support temperature and gas pressure for forming the surface layer 305 may include the ranges given above, but conditions are by no means independently separately determined in usual cases. Optimum values should be determined on the basis of mutual and systematic relationship so that photosensitive members having the desired characteristics can be formed.

a-Si Photosensitive Member Film Formation Apparatus

Figure 5:
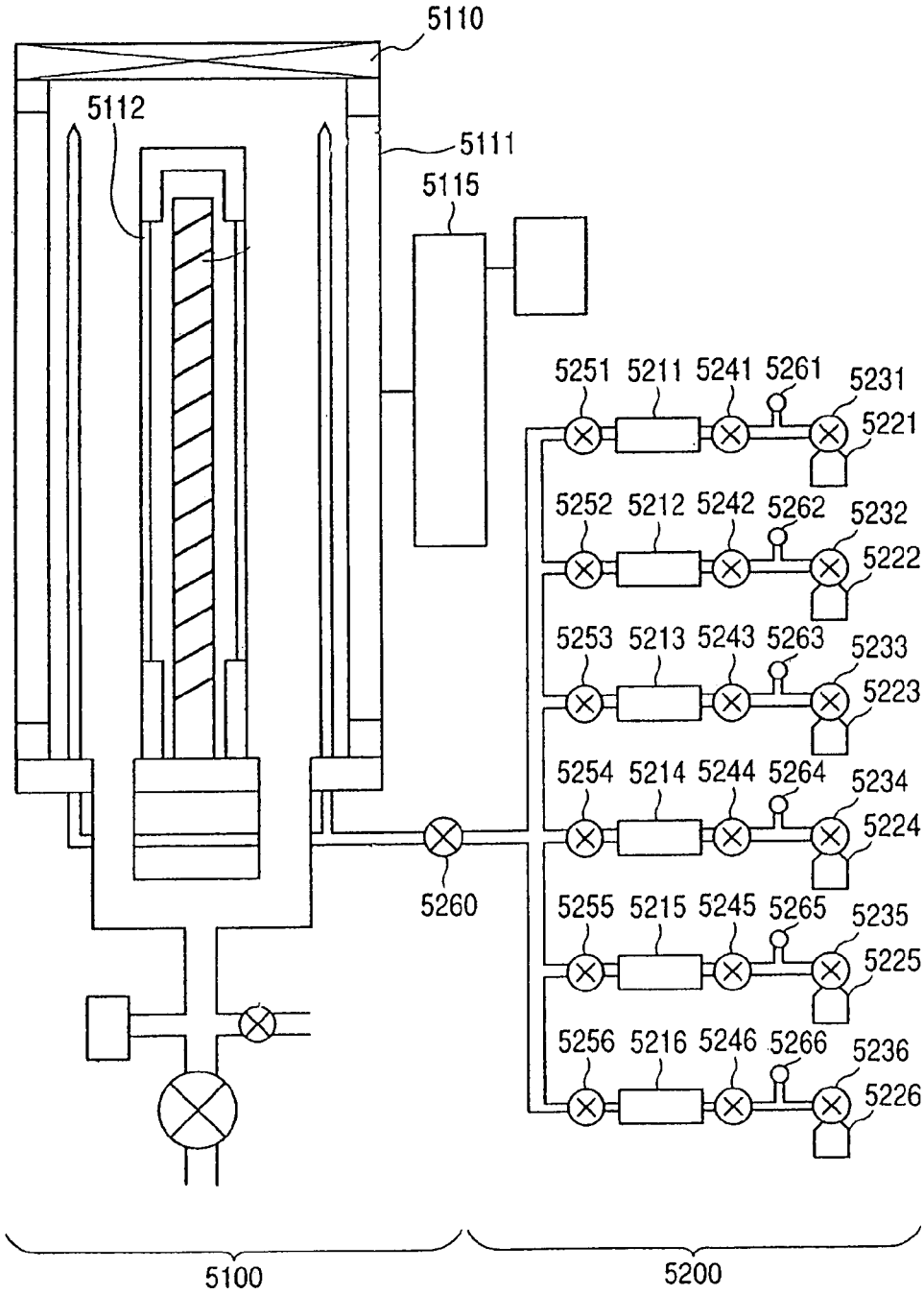
FIG. 5 is a diagrammatic sectional view of an a-Si photosensitive member production system making use of RF.
Figure 6:
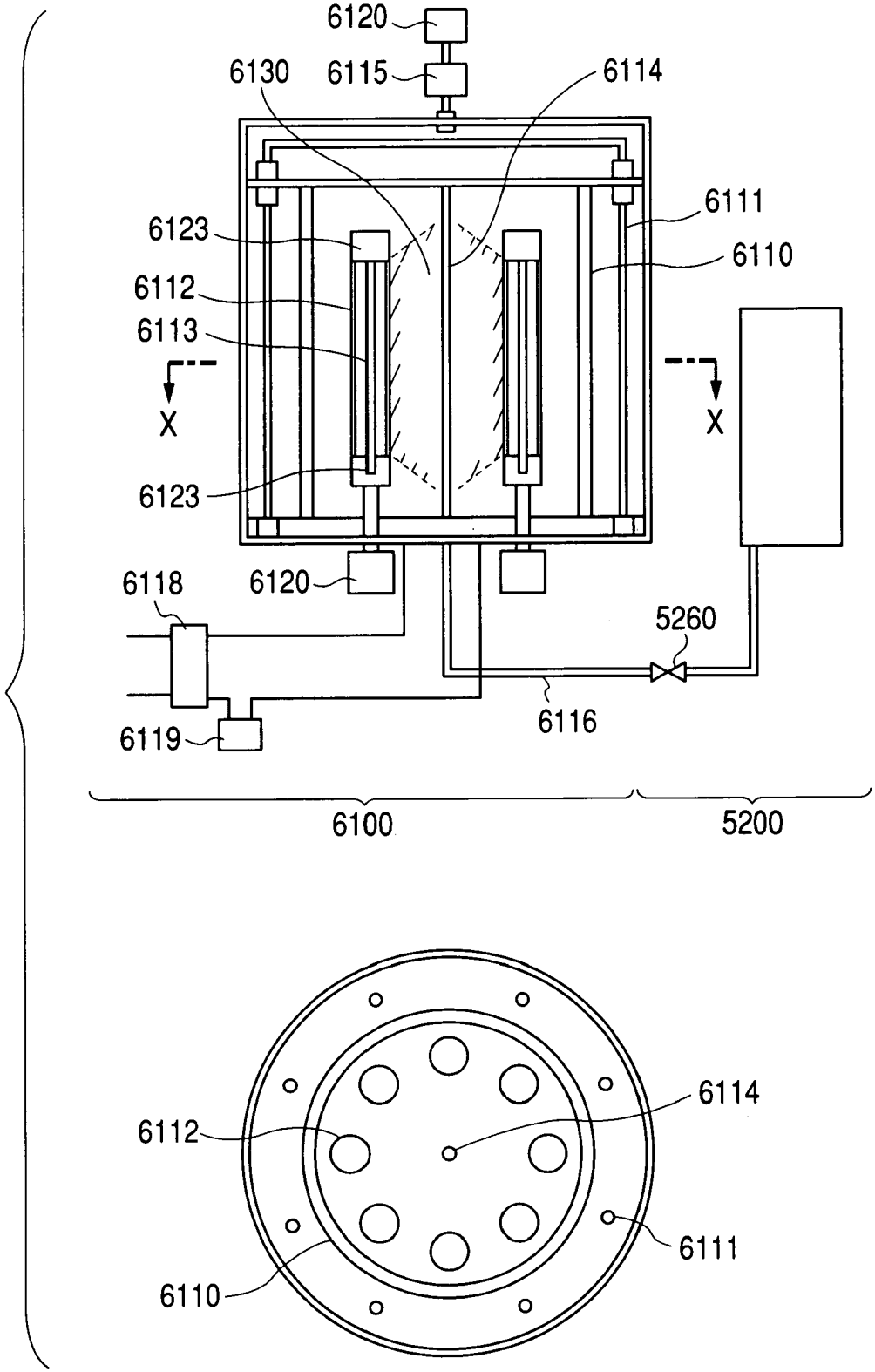
FIG. 6 is a diagrammatic sectional view of an a-Si photosensitive-member production system making use of VHF.

FIG. 5 diagrammatically illustrates an example of a deposition apparatus for producing the photosensitive member by radio frequency (RF) plasma-assisted CVD making use of an RF band high-frequency power source. FIG. 6 diagrammatically illustrates an example of a deposition apparatus for producing the photosensitive member by VHF plasma-assisted CVD making use of a VHF power source having a higher frequency than the RF band.

These apparatus are each constituted chiefly of a deposition system 5100 or 6100, a source gas feed system 5200 and an exhaust system (not shown) for evacuating the inside of a reactor 5110 or 6110. The apparatus shown in FIGS. 5 and 6 are constructed by interchanging the deposition system 5100 shown in FIG. 5 and the deposition system 6100 shown in FIG. 6.

Here, the high-frequency power to be applied is supplied from a VHF power source with a frequency of from 50 MHz to 450 MHz, e.g., a frequency of 105 MHz. The pressure is kept at approximately from 13.3 mPa to 1,330 Pa, i.e., a pressure a little lower than that in the RF plasma-assisted CVD.

In the reactor 6110 in the deposition system 6100, cylindrical supports 6112, heaters 6113 for heating the supports, and a source gas feed pipe 6114 are provided. A high-frequency power source 6120 is connected to the reactor via a high-frequency matching box 6115.

The source gas feed system 5200 is, as shown in FIG. 5, constituted of gas cylinders 5221 to 5226 for source gases such as $SiH_4$, $H_2$, $CH_4$, NO, $B_2H_6$ and $CF_4$, valves 5231 to 5236, 5241 to 5246 and 5251 to 5256, and mass flow controllers 5211 to 5216. The gas cylinders for the respective constituent gases are connected to the gas feed pipe 6114 in the reactor 6110 via a valve 5260.

The cylindrical supports 6112 are set on conductive supporting stands 6123 and are thereby connected to the ground.

An example of the procedure of forming photosensitive members by means of the apparatus shown in FIG. 6 is described below.

The cylindrical supports 6112 are set in the reactor 6110, and the inside of the reactor 6110 is evacuated by means of an exhaust device (e.g., a vacuum pump; not shown). Subsequently, the temperature of each cylindrical support 6112 is controlled at a desired temperature of from 200° C. to 450° C., and preferably from 250° C. to 350° C., by means of the heaters 6113 for heating the supports. Next, in order that source gases for forming the photosensitive members are flowed into the reactor 6110, gas cylinder valves 5231 to 5236 and a leak valve (not shown) of the reactor are checked to make sure that they are closed, and also flow-in valves 5241 to 5246, flow-out valves 5251 to 5256 and an auxiliary valve 5260 are checked to make sure that they are opened. Then, a main valve 6118 is opened to evacuate the insides of the reactor 6110 and gas feed pipe 6116.

Thereafter, at the time a vacuum gauge 6119 has been read to indicate a pressure of 0.5 mPa, the auxiliary valve 5260 and the flow-out valves 5251 to 5256 are closed. Then, valves 5231 to 5236 are opened so that gases are respectively introduced from gas cylinders 5221 to 5226, and each gas is controlled to have a pressure of 0.2 MPa by operating pressure controllers 5261 to 5266. Next, the flow-in valves 5241 to 5246 are slowly opened so that gases are respectively introduced into mass flow controllers 5211 to 5216.

After the film formation has been made ready to start as a result of the above procedure, the photoconductive layer is formed on each cylindrical support 6112.

That is, at the time the cylindrical supports 6112 has had the desired temperature, some necessary ones among the flow-out valves 5251 to 5256 and the auxiliary valve 5260 are slowly opened so that desired source gases are fed into the reactor 6110 from the gas cylinders 5221 to 5226 through a gas feed pipe 6114. Next, the mass flow controllers 5211 to 5216 are operated so that each source gas is so adjusted as to flow at a desired rate. In that course, the opening of the main valve 6118 is adjusted while watching the vacuum gauge 6119 SO that the pressure inside the reactor 6110 comes to a desired pressure of from 13.3 mPa to 1,330 Pa. At the time the inner pressure has become stable, a high-frequency power source 6120 is set at a desired electric power and, using, e.g., a VHF power source with a frequency of from 50 MHz to 450 MHz, e.g., 105 MHz, high-frequency power is supplied to a cathode electrode 6111 through the high-frequency matching box 6115 to cause high-frequency glow discharge to take place. The source gases fed into the reactor 6110 are decomposed by the discharge energy thus generated, so that the desired first layer composed chiefly of silicon atoms is formed on the cylindrical support 6112.

With this apparatus, in a discharge space 6130 surrounded by the cylindrical supports 6112, the source gases fed are excited by discharge energy to be dissociated, and a stated deposited film is formed on each cylindrical support 6112. Here, the cylindrical support is rotated at a desired rotational speed by means of a support-rotating motor 6120 so that the layer can uniformly be formed.

After a film with a desired thickness has been formed, the supply of high-frequency power is stopped, and the flow-out valves 5251 to 5256 are closed to stop gases from flowing into the reactor 6110. The formation of a first-time photoconductive layer region is thus completed. The composition and layer thickness of the photoconductive layer region may be set according to known conventional ones. Also when the lower-part blocking layer is provided between the photoconductive layer region and the support, basically the above procedure may previously be repeated.

It is important that each cylindrical support on which films have been formed up to the first-time photoconductive layer region by the procedure described above is first taken out of the reactor 6110, a first reactor, and is moved to a second reactor.

Then, it is important that photoconductive layer regions each having a stated thickness are deposited over a plurality of times.

The SiC type surface layer may further be formed at the outermost surface, using an Si-containing gas and a carbon-containing gas. Also in that case, basically the above procedure may be repeated.

In the case of the RF plasma-assisted CVD shown in FIG. 5, the high-frequency power applied has a frequency of from 1 MHz to less than 50 MHz, e.g., 13.56 MHz, and such high-frequency power is supplied to a cathode electrode 5111 through the high-frequency matching box 5115 to cause high-frequency glow discharge to take place. The source gases fed into the film-forming furnace 5110 are decomposed by the discharge energy thus generated, so that the photoconductive layer composed chiefly of silicon atoms and consisting of a plurality of photoconductive layer regions is formed on the cylindrical substrate 5112. During this film formation, the pressure is kept at approximately from 13.3 Pa to 1,330 Pa, which is a little higher than that in the VHF plasma-assisted CVD process.

Other procedures are the same as in the film formation using the apparatus shown in FIG. 6.

Electrophotographic Apparatus

Figure 9:
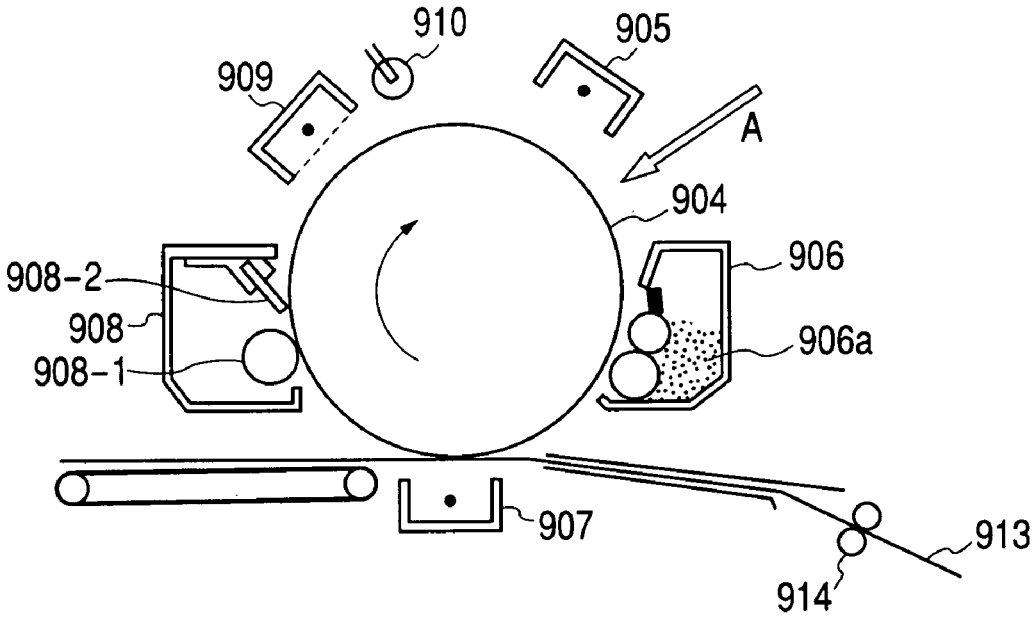
FIG. 9 is a diagrammatic sectional view of an example of an image-forming apparatus in the present invention.

An example of an electrophotographic apparatus making use of the electrophotographic photosensitive member of the present invention is shown in FIG. 9. The apparatus of this example is suited when a cylindrical electrophotographic photosensitive member is used. The electrophotographic apparatus of the present invention is by no means limited to this example, and the photosensitive member may have any desired shape such as the shape of an endless belt.

In FIG. 9, reference numeral 904 denotes the electrophotographic photosensitive member which is referred to in the present invention; and 905, a primary charging assembly which performs charging in order to form an electrostatic latent image on the photosensitive member 904. In FIG. 9, a corona charging assembly is illustrated. Instead, a contact charging assembly may be used. Reference numeral 906 denotes a developing assembly for feeding a developer (toner) **906*a* to the photosensitive member 904, on which the electrostatic latent image has been formed; and 907, a transfer charging assembly for transferring the toner on the photosensitive member surface to a transfer material. In FIG. 9, a corona charging assembly is illustrated. Instead, a roller electrode may be used. Reference numeral 908 denotes a cleaner with which the photosensitive member surface is cleaned. In this example, in order to perform uniform cleaning of the photosensitive member surface effectively, the photosensitive member is cleaned by means of an elastic roller 908-1 and a cleaning blade 908-2. However, other construction may also be designed in which only any one of them is provided or the cleaner 908 itself is not provided. Reference numerals 909 and 910 denote an AC charge eliminator and a charge elimination lamp, respectively, for eliminating electric charges from the photosensitive member surface so as to be prepared for the next-round copying operation. Of course, other construction may also be designed in which any one of them is not provided or both of them are not provided. Reference numeral 913 denotes a transfer material such as paper; and 914**, a transfer material feed roller. As a light source of exposure A, used is a halogen light source or a light source such as a laser which is coherent or LED whose wavelength is mainly single.

Using such an apparatus, copied images are formed, e.g., in the following way.

First, the electrophotographic photosensitive member 904 is rotated in the direction of an arrow at a stated speed, and the surface of the photosensitive member 904 is uniformly electrostatically charged by means of the primary charging assembly 905. Next, the surface of the photosensitive member 904 thus charged is subjected to exposure A to form an electrostatic latent image on the surface of the photosensitive member 904 charged. When part of the surface of the photosensitive member 904 where the electrostatic latent image has been formed passes through the part provided with the developing assembly 906, the toner is fed to the surface of the photosensitive member 904 by means of the developing assembly 906, and the electrostatic latent image is rendered visible (developed) to be an image formed of the toner 906*a* (toner image). As the photosensitive member 904 is further rotated, this toner image reaches the part provided with the transfer charging assembly 907, where the toner is transferred to the transfer material 913 conveyed by means of the feed roller 914.

After the transfer has been completed, for the next copying step, the surface of the photosensitive member 904 is cleaned to remove residual toner therefrom by means of the cleaner 908, and is subjected to charge elimination by means of the charge eliminator 909 and charge elimination lamp 910 so that the potential of that surface is zero or almost zero. Thus, a first-time copying step is completed.

Electrophotographic Photosensitive Member

Production Apparatus Making Use of Vacuum Transport System

Figure 10:
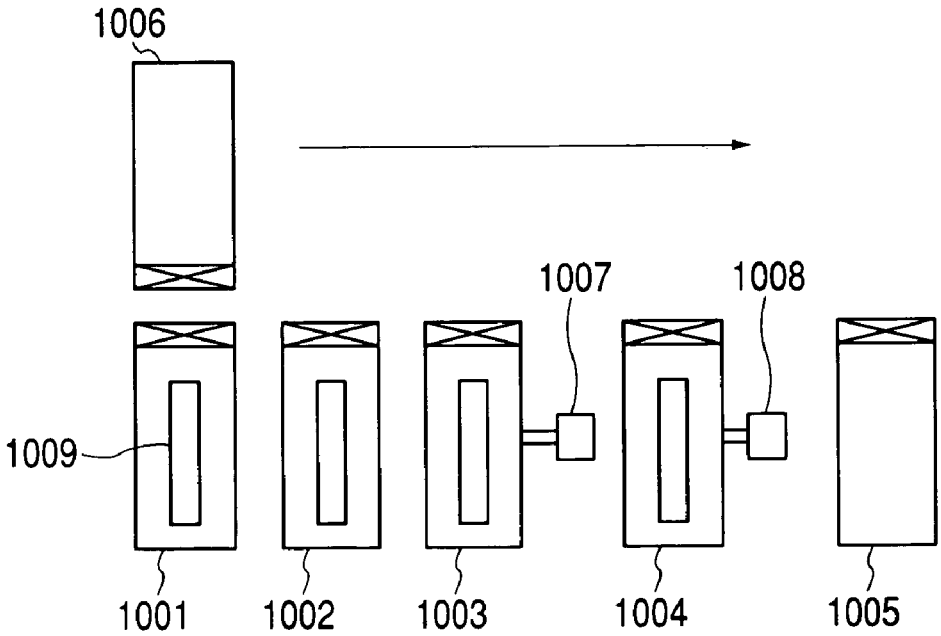
FIG. 10 is a diagrammatic sectional view of an a-Si photosensitive-member production system having a vacuum transport system used in the present invention.

As shown in FIG. 10, an electrophotographic photosensitive member production system of this embodiment has a support-loading chamber 1001 for loading into the production system a cylindrical support 1009 formed of a conductive material, a support-heating chamber 1002 for heating the cylindrical support 1009 to a stated temperature, reactors (reaction chambers) 1003 and 1004 for forming a photoconductive layer on the cylindrical support 1009, and a vacuum transport chamber (transporting vacuum chamber) 1006 via which the support is moved to the reactor in a vacuum-airtight state. A cylindrical support 1009 on which the photoconductive layer has halfway been deposited in the reactor 1003 is moved to another reactor 1004 by means of the vacuum transport chamber 1006, where the photoconductive layer region 304 and the surface layer 305 are deposited. Then, the cylindrical support 1009 on which deposited films have been formed is moved to an unloading chamber (support-cooling and -delivery chamber) 1005 for unloading this support from the production system.

This system is so constructed that the cylindrical support 1009 loaded into the support-loading chamber 1001 is transported to the support-heating chamber 1002, the reactor 1003, the reactor 1004 and the unloading chamber 1005 in this order by means of the vacuum transport chamber 1006. In addition, a first high-frequency power source 1007 which supplies a high-frequency power to the interior of the reactor 1003 is connected to the reactor 1003, and a second high-frequency power source 1008 which supplies a high-frequency power to the interior of the reactor 1004 is connected to the reactor 1004.

EXAMPLES

The present invention is described below in greater detail by giving Experiments and Examples. The present invention is by no means limited by these.

Experiment 1

Figure 7:
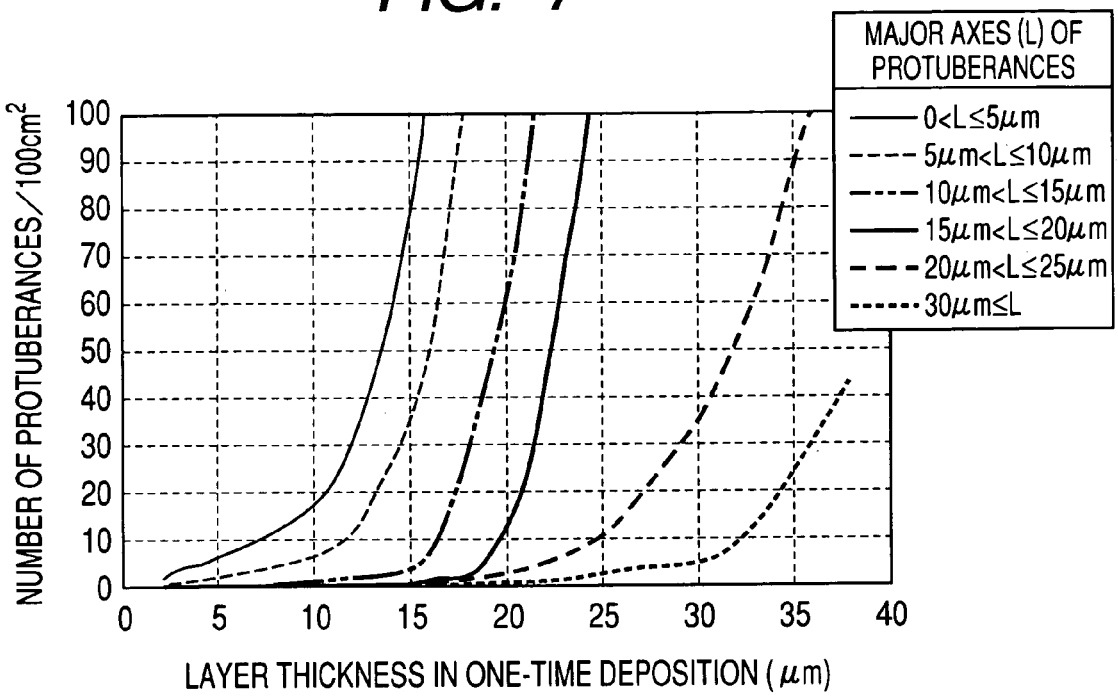
FIG. 7 is a graph showing the relationship between the thickness of a photoconductive layer deposited at one time and the number of protuberances.

Using the a-Si photosensitive member production apparatus shown in FIG. 5, a photosensitive member was produced by one-time deposition of a photoconductive layer on an aluminum support of 108 mm in external diameter and 5 mm in wall thickness under the conditions shown in Table 1. Here, the layer thickness of the photoconductive layer was changed from 2 to 38 μm to prepare six samples (photosensitive members). The surfaces of the photosensitive members were observed using an optical microscope to examine the relationship between the thickness of the photoconductive layer and the number of protuberances. The size and number of protuberances per 100 $cm^2$ on these photosensitive member surfaces were measured and counted. The results of measurement and count are graphed in FIG. 7.

TABLE 1

| | Photoconductive layer |
|---|---|
| Source gases and flow rates: | |
| $SiH_4$ [ml/min (normal)] | 200 |
| $H_2$ [ml/min (normal)] | 400 |
| Support temperature: (° C.) | 240 |
| Reactor internal pressure: (Pa) | 70 |
| High-frequency power: (W) (13.56 MHz) | 500 |
| Layer thickness: (μm) | changed |

Experiment 2

Using the a-Si photosensitive member production apparatus shown in FIG. 5, ten photosensitive members were produced in each of which a lower-part blocking layer, a photoconductive layer and a surface layer were deposited on the same aluminum support as used in Experiment 1 under the conditions shown in Table 2. Here, each photoconductive layer was deposited under the same conditions as in Experiment 1, but in a constant layer thickness of 30 μm.

The size of protuberances on the surfaces of the ten photosensitive members was measured with an optical microscope.

Next, in order to measure the size of black dots caused by the protuberances thus measured, the electrophotographic photosensitive members produced in this Experiment were each set in an electrophotographic apparatus employing a corona discharge system as a primary discharge assembly and having a cleaning blade in a cleaner, to form images. Stated specifically, using GP605 (process speed: 300 mm/sec image exposure), manufactured by CANON INC., an A3-size white blank original was copied. Images thus obtained were observed, and the major axes of black dots were measured.

Figure 8:
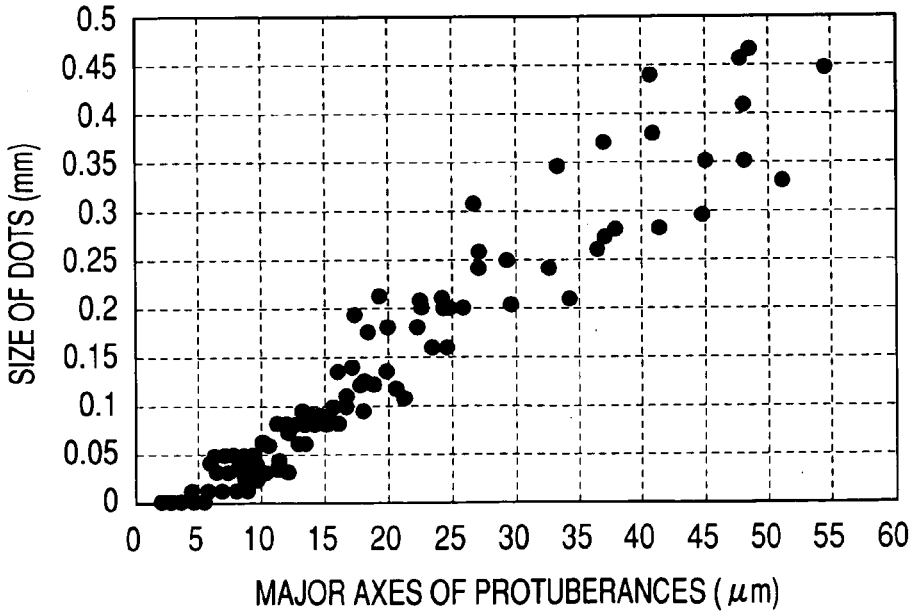
FIG. 8 is a graph showing the relationship between the major axes of protuberances and the size of dots.

Next, the number of the black dots was counted. The relationship between the size (major axis) of protuberances on the photosensitive member surface and the size of dots are shown in FIG. 8.

TABLE 2

| | Lower = part blocking layer | Photoconductive layer | Surface layer |
|---|---|---|---|
| Source gases and flow rates: | | | |
| $SiH_4$ [ml/min (normal)] | 200 | 200 | 50 |
| $H_2$ [ml/min (normal)] | — | 400 | — |
| $B_2H_6$ (ppm) (based on $SiH_4$) | 1,000 | — | — |
| NO [ml/min (normal)] | 15 | — | — |
| $CH_4$ [ml/min (normal)] | — | — | 500 |
| Substrate temperature: (° C.) | 220 | 240 | 220 |
| Reactor internal pressure: (Pa) | 67 | 70 | 67 |
| High-frequency power: (W) (13.56 MHz) | 300 | 500 | 300 |
| Layer thickness: (μm) | 3 | 30 | 0.5 |

As can be seen from Table 7, protuberances of more than 10 μm in major axis are formed in a large number when the layer thickness is larger than 15 μm. As can also be seen from Table 8, protuberances causative of black dots of more than 0.1 mm in size are protuberances having major axes of more than 15 μm. As can further be seen therefrom, protuberances causative of black dots of more than 0.05 mm in size are protuberances having major axes of more than 10 μm.

From the foregoing, it is important that protuberances having major axes of more than 15 μm are not made to form, namely, that the layer thickness deposited in one reactor is made to be not more than 15 μm. Also, it is preferable that the number of protuberances having major axes of 15 μm or more is 5 or less per 100 $cm^2$. More preferably, it is important that the number of protuberances having major axes of 10 μm or more are so controlled as to be 10 or less per 100 $cm^2$, namely, that the layer thickness deposited in one reactor is made to be not more than 12 μm.

Example 1

Using the production apparatus shown in FIG. 5, a photosensitive member was produced in which a lower-part blocking layer and up to a first-time photoconductive layer region were deposited on an aluminum support of 108 mm in external diameter and 5 mm in wall thickness under the conditions shown in Table 3. Then, in that state, this was moved to a different reactor in a vacuum condition by means of a transport chamber, where the second deposition was carried out under the conditions shown in Table 4 to form a second-time photoconductive layer region superposingly. Further, until the layer thickness of the photoconductive layer reached 30 μm, deposition was carried out a plurality of times according to the layer thickness of each photoconductive layer region deposited in each reactor, as shown in Table 6, while moving the photosensitive member under production to a different reactor one after another. In the last reactor, a surface layer shown in Table 5 was deposited.

Electrophotographic photosensitive members, Samples A to I, were prepared by the above procedure.

TABLE 3

| | Lower-part blocking layer | Photoconductive = layer region (1st time) |
|---|---|---|
| Source gases and flow rates: | | |
| $SiH_4$ [ml/min (normal)] | 200 | 150 |
| $H_2$ [ml/min (normal)] | — | 600 |
| $B_2H_6$ (ppm) (based on $SiH_4$) | 1,000 | — |
| NO [ml/min (normal)] | 15 | — |
| Support temperature: (° C.) | 220 | 270 |
| Reactor internal pressure: (Pa) | 67 | 70 |
| High-frequency power: (W) (13.56 MHz) | 300 | 600 |
| Layer thickness: (μm) | 0.3 | Table 6 |

TABLE 4

| | Photoconductive-layer region (2nd and following times) |
|---|---|
| Source gases and flow rates: | |
| $SiH_4$ [ml/min (normal)] | 150 |
| $H_2$ [ml/min (normal)] | 600 |
| Support temperature: (° C.) | 270 |
| Reactor internal pressure: (Pa) | 70 |
| High-frequency power: (W) (13.56 MHz) | 600 |
| Layer thickness: (μm) | Table 6 |

TABLE 5

| | Surface layer |
|---|---|
| Source gases and flow rates: | |
| $SiH_4$ [ml/min (normal)] | 100 |
| $CH_4$ [ml/min (normal)] | 650 |
| Support temperature: (° C.) | 240 |
| Reactor internal pressure: (Pa) | 67 |
| High-frequency power: (W) (13.56 MHz) | 300 |
| Layer thickness: (μm) | 0.6 |

TABLE 6

| Sample | Photoconductive = layer region layer thickness 1st time (μm) | 2nd ff (μm) | Last-time deposition (photoconductive layer region + surface layer) | Number of times of discontinuous processing |
|---|---|---|---|---|
| A | 2 | 2 | Surface layer only | 14 |
| B | 3 | 3 | Surface layer only | 9 |
| C | 3 | 5 | Photoconductive layer region: 2 μm | 6 |
| D | 3 | 6 | Photoconductive layer region: 3 μm | 5 |
| E | 4 | 7 | Photoconductive | 4 |

TABLE 6-continued

| Sample | Photoconductive = layer region layer thickness 1st time (μm) | 2nd ff (μm) | Last-time deposition (photoconductive layer region + surface layer) | Number of times of discontinuous processing |
|---|---|---|---|---|
| | | | layer region: 5 μm | |
| F | 7 | 10 | Photoconductive layer region: 3 μm | 3 |
| G | 8 | 11 | Photoconductive layer region: 11 μm | 2 |
| H | 12 | 12 | Photoconductive layer region: 6 μm | 3 |
| I | 15 | 15 | Surface layer only | 1 |

The photosensitive members obtained following the above procedure were used under positive charging, and were evaluated in the following way.

Number of protuberances:

The surface of each photosensitive member obtained was observed using an optical microscope. Then, the number of protuberances of 10 μm or more in major axis was counted to examine their number per 100 $cm^2$.

The results obtained were ranked by relative comparison defining the value obtained in Comparative Example 1 as 100%.

A: From 0% or more to less than 15%.
B: From 15% or more to less than 30%.
C: From 30% or more to less than 50%.
D: From 50% or more to less than 80%.
E: From 80% or more to less than 105%.

Image Defects:

The electrophotographic photosensitive members obtained in this Example were each set in an electrophotographic apparatus employing a corona discharge system as a primary discharge assembly and having a cleaning blade in a cleaner, and images were formed. Stated specifically, a copying machine GP605 (manufactured by CANON INC.; process speed: 300 mm/sec; image exposure) was used.

When negative-charging photosensitive members were evaluated, GP605 was used as a base machine, which was so remodeled that negative charging was performable, and the toner was changed for a negative toner. Using this copying machine as a test electrophotographic apparatus, an A3-size white blank original was copied. Images thus obtained were observed, and the number of black dots resulting from protuberances of 0.1 mm or more in major axis was counted.

The results obtained were ranked by relative comparison defining the value obtained in Comparative Example 1 as 100%.

A: From 0% or more to less than 15%.
B: From 15% or more to less than 30%.
C: From 30% or more to less than 50%.
D: From 50% or more to less than 80%.
E: From 80% or more to less than 105%.

Charging Performance:

Each electrophotographic photosensitive member was set in the electrophotographic apparatus, and a high-voltage of +6 kV (−6 kV in the case of negative charging) was applied to its charging assembly to perform corona charging, where the dark-area surface potential of the electrophotographic photosensitive member was measured with a surface potentiometer installed at the position of the developing assembly.

The results obtained were ranked by relative evaluation defining the value obtained in Comparative Example 1 as 100%. The comparison of the numerical values were made using their absolute values.

A: 120% or more.
B: From 110% or more to less than 120%.
C: From 105% or more to less than 110%.
D: From 95% or more to less than 105%.
E: Less than 95%.

Residual Potential:

Each electrophotographic photosensitive member was charged to a constant dark-area surface potential (450 V) (−450 V in the case of negative charging). Then, this was immediately irradiated with relatively strong light (15 Lux·sec) in a constant amount of light. Here, the residual potential of the electrophotographic photosensitive member was measured with a surface potentiometer installed at the position of the developing assembly.

The results obtained were ranked by relative evaluation defining the value obtained in Comparative Example 1 as 100%. The comparison of the numerical values were made using their absolute values.

A: Less than 75%.
B: From 75% or more to less than 85%.
C: From 85% or more to less than 95%.
D: From 95% or more to less than 105%.
E: 105% or more.

Potential Uniformity:

Each electrophotographic photosensitive member was charged to a constant dark-area surface potential (450 V) (−450 V in the case of negative charging). Then, this was immediately irradiated with light (0.5 Lux·sec) in a constant amount of light. Here, the amount of light was so adjusted that the surface potential of the electrophotographic photosensitive member at its middle portion in the drum axial direction, measured with a surface potentiometer installed at the position of the developing assembly, came to about 200 V (−200 V in the case of negative charging). Then, the potential distribution in the peripheral direction and drum axial direction was measured, and the value of a maximum value minus a minimum value was calculated.

The results obtained were ranked by relative evaluation defining the value obtained in Comparative Example 1 as 100%. The comparison of the numerical values were made using their absolute values.

A: Less than 85%.
B: From 85% or more to less than 95%.
C: From 95% or more to less than 105%.
D: From 105% or more to less than 110%.
E: 110% or more.

Costs:

Production time for each photosensitive member was calculated, and was defined as costs for each. The VHF system deposition apparatus shown in FIG. 6 can produce eight electrophotographic photosensitive members each time. The RF system deposition apparatus shown in FIG. 5 produces one electrophotographic photosensitive members each time.

The results obtained were ranked by relative evaluation defining the value obtained in Comparative Example 1 as 100%.

A: Less than 95%.
B: From 95% or more to less than 110%.
C: From 110% or more to less than 125%.
D: From 125% or more to less than 140%.
E: 140% or more.

Overall Evaluation:

Overall evaluation was ranked putting emphasis on the effect of remedying image defects, i.e., the effect of the present invention.

A: Very good

B: Good

C: A little good

D: No problem in practical use.

E: Problematic in practical use.

Overall evaluation was made by the above methods. The results are shown in Table 8 together with those of Comparative Example 1.

Comparative Example 1

Using the production apparatus shown in FIG. 5, a lower-part blocking layer, a photoconductive layer and a surface layer were continuously deposited on an aluminum support of 108 mm in external diameter and 5 mm in wall thickness, in one reactor under the conditions shown in Table 7. The positive-charging photosensitive member thus produced was evaluated in the same manner as in Example 1 to obtain the results shown in Table 8.

TABLE 7

| | Lower = part blocking layer | Photoconductive layer | Surface layer |
|---|---|---|---|
| Source gases and flow rates: | | | |
| $SiH_4$ [ml/min(normal)] | 200 | 150 | 100 |
| $H_2$ [ml/min(normal)] | — | 600 | — |
| $B_2H_6$ (ppm) (based on $SiH_4$) | 1,000 | — | — |
| NO [ml/min(normal)] | 15 | — | — |
| $CH_4$ [ml/min(normal)] | — | — | 650 |
| Substrate temperature: (° C.) | 220 | 270 | 240 |
| Reactor internal pressure: (Pa) | 67 | 70 | 67 |
| High-frequency power: (W) (13.56 MHz) | 300 | 600 | 300 |
| Layer thickness: (μm) | 3 | 30 | 0.6 |

TABLE 8

| | Example 1 | | | | | | | | | Comp. |
|---|---|---|---|---|---|---|---|---|---|---|
| Evaluation | A | B | C | D | E | F | G | H | I | Ex. 1 |
| Number of protuberances: | A | B | B | B | B | B | C | C | C | E |
| Number of image defects: | A | B | B | B | B | B | C | C | C | E |
| Charging performance: | C | C | C | C | C | C | C | C | C | C |
| Residual potential: | C | C | C | C | C | C | C | C | C | C |
| Potential uniformity: | C | C | C | C | C | C | C | C | C | C |
| Costs: | D | D | D | C | C | C | B | B | B | B |
| Overall evaluation: | C | C | C | A | A | A | B | B | B | D |

As can be seen from Table 8 (with reference to FIG. 6), the number of protuberances and the number of image defects, dots, can be extremely reduced when the thickness of each layer region deposited in each reactor is 15 μm or less. However, the number of times of the changing of reactors increases as the thickness of each layer region deposited in each reactor is made smaller, resulting in a rise in costs. Accordingly, the number of times of the changing of reactors is seen to be preferably 1 to 5 times.

Example 2

Using the production apparatus shown in FIG. 5, the respective layers were deposited on the same aluminum support as used in Example 1 in the same manner as in Example 1 but under conditions shown in Table 9 to produce positive-charging photosensitive members 2-A to 2-F. As to the photoconductive layer, the thickness of each layer region deposited in each reactor was changed as shown in Table 10.

Further, using the production apparatus shown in FIG. 5, a lower-part blocking layer, a photoconductive layer and a surface layer were deposited on the same aluminum support as that in Example 1 in one reactor under conditions shown in Table 9, to produce positive-charging photosensitive members 2-G to 2-I. As to the photoconductive layer, the thickness of each layer region deposited in the same reactor was changed as shown in Table 10.

The positive-charging photosensitive members thus produced were evaluated in the same manner as in Example 1 to obtain the results shown in Table 11.

TABLE 9

| | Lower = part blocking layer | Photoconductive layer | Surface layer |
|---|---|---|---|
| Source gases and flow rates: | | | |
| $SiH_4$ [ml/min(normal)] | 150 | 150 | 35 |
| $H_2$ [ml/min(normal)] | 800 | 800 | — |
| $B_2H_6$ (ppm) (based on $SiH_4$) | 500 | 0.3 | — |
| NO [ml/min(normal)] | 10 | — | — |
| $CH_4$ [ml/min(normal)] | — | — | 750 |
| Substrate temperature: (° C.) | 260 | 275 | 250 |
| Reactor internal pressure: (Pa) | 59 | 65 | 57 |
| High-frequency power: (W) (13.56 MHz) | 300 | 300 | 240 |
| Layer thickness: (μm) | 3 | Table 10 | 0.5 |

TABLE 10

| | Photoconductive = layer region layer thickness | | Photoconductive | Number of times of |
|---|---|---|---|---|
| Sample | 1st time (μm) | 2nd ff (μm) | layer layer thickness | discontinuous processing |
| Example: | | | | |
| 2-A | 5 | 5 | 10 | 1 |
| 2-B | 5 | 5 | 15 | 2 |
| 2-C | 10 | 10 | 20 | 1 |
| 2-D | 12 | 12 | 36 | 2 |
| 2-E | 10 | 10 | 60 | 5 |
| 2-F | 15 | 15 | 60 | 3 |
| 2-G | 2 | 2 | 10 | 4 |
| 2-H | 15 | 16 | 31 | 1 |
| 2-I | 5 | 15 | 65 | 4 |

TABLE 11

| | Example 2 | | | | | | | | |
|---|---|---|---|---|---|---|---|---|---|
| Evaluation | A | B | C | D | E | F | G | H | I |
| Number of protuberances: | B | B | B | B | C | C | B | D | D |
| Number of image defects: | B | B | B | B | C | C | B | D | D |

TABLE 11-continued

| Evaluation | Example 2 | | | | | | | | |
|---|---|---|---|---|---|---|---|---|---|
| | A | B | C | D | E | F | G | H | I |
| Charging performance: | D | D | C | C | B | B | D | C | C |
| Residual potential: | C | C | C | C | B | C | C | C | C |
| Potential uniformity: | C | B | C | C | C | C | B | C | D |
| Cost: | B | C | B | C | C | B | C | C | D |
| Overall evaluation: | B | B | A | A | B | B | C | C | D |

As can be seen from Table 11 (with reference to Table 10), the number of protuberances and the number of image defects, dots, can be extremely reduced inasmuch as the reactor is changed while the thickness of each photoconductive layer region is 3 μm or more to 15 μm or less from the support side. It is seen that as the layer thickness of the photoconductive layer increases, charging performance and residual potential are improved, but it is disadvantageous to protuberances, image defects and costs. From the foregoing, it is seen to be overall favorable that the layer thickness of the photoconductive layer is 10 μm or more to 60 μm or less.

Example 3

In Example 2, a positive-charging electrophotographic photosensitive member was produced with regional changes in the surface layer. A lower-part blocking layer, a photoconductive layer and a surface layer were deposited on the same aluminum support as in Example 2 under conditions shown in Table 12. Here, to form the photoconductive layer, photoconductive layer regions were deposited changing the reactor for each deposition in a thickness of 10 μm.

TABLE 12

| | Lower = part blocking layer | Photoconductive layer | Surface layer |
|---|---|---|---|
| Source gases and flow rates: | | | |
| $SiH_4$ [ml/min(normal)] | 350 | 450 | 250→30→12 |
| $H_2$ [(ml/min(normal)] | 700 | 2,000 | — |
| $B_2H_6$ (ppm) (based on $SiH_4$) | 2,000 | 0.2 | — |
| NO [ml/min(normal)] | 40 | — | — |
| $CH_4$ [ml/min(normal)] | — | — | 5→60→600 |
| Substrate temperature: (° C.) | 260 | 275 | 240 |
| Reactor internal pressure: (Pa) | 55 | 65 | 44 |
| High-frequency power: (W) (13.56 MHz) | 350 | 800 | 400 |
| Layer thickness: (μm) | 2 | 10 (three times) | 0.6 |

The positive-charging photosensitive member thus produced was evaluated in the same manner as in Example 1 to obtain the results shown in Table 14.

Example 4

A positive-charging electrophotographic photosensitive member was obtained in the same manner as in Example 3 except that a lower-part blocking layer, a photoconductive layer and a surface layer were deposited on the aluminum support under conditions shown in Table 13, where the deposition conditions for the photoconductive layer were different from those in Example 3. Here, to form the photoconductive layer, photoconductive layer regions were deposited changing the reactor for each deposition in a thickness of 10 μm.

TABLE 13

| | Lower = part blocking layer | Photoconductive layer | | Surface layer |
|---|---|---|---|---|
| | | Photo-conductive layer region | Photo-conductive layer region | |
| Source gases and flow rates: | | | | |
| $SiH_4$ [ml/min(normal)] | 350 | 450 | 180 | 250→30→12 |
| $H_2$ [ml/min(normal)] | 700 | 2,000 | 1,500 | — |
| $B_2H_6$ (ppm) (based on $SiH_4$) | 2,000 | 0.2 | — | — |
| NO [ml/min(normal)] | 40 | — | — | — |
| $CH_4$ [ml/min(normal)] | — | — | — | 5→60→600 |
| Substrate temperature: (° C.) | 260 | 275 | 260 | 240 |
| Reactor internal pressure: (Pa) | 55 | 65 | 58 | 44 |
| High-frequency power: (W) (13.56 MHz) | 350 | 800 | 250 | 400 |
| Layer thickness: (μm) | 2 | 10 (twice) | 10 (once) | 0.6 |

The positive-charging photosensitive member thus produced was evaluated in the same manner as in Example 1 to obtain the results shown in Table 14.

TABLE 14

| Evaluation | Example 3 | Example 4 |
|---|---|---|
| Number of protuberances: | B | B |
| Number of dots: | B | B |
| Charging performance: | C | C |
| Residual potential: | C | C |
| Potential uniformity: | C | C |
| Costs: | C | C |
| Overall evaluation: | A | A |

As can be seen from Table 14, also when the surface layer is provided with change regions and also when the photoconductive layer is formed by superposing the photoconductive layer regions under different deposition conditions, the effect of the present invention can be obtained and the number of protuberances and the number of image defects, dots, can be extremely reduced inasmuch as the reactor is changed while the thickness of each photoconductive layer region is 3 μm or more to 15 μm or less from the support side.

Example 5

A negative-charging electrophotographic photosensitive member was obtained in the same manner as in Example 2 except that a lower-part blocking layer, a photoconductive layer, an upper-part blocking layer and a surface layer were deposited under conditions shown in Table 15. Here, to form the photoconductive layer, photoconductive layer regions were deposited changing the reactor for each deposition in a thickness of 10 μm.

TABLE 15

| | Lower = part blocking layer | Photo-conductive layer | Upper = part blocking layer | Surface layer |
|---|---|---|---|---|
| Source gases and flow rates: | | | | |
| $SiH_4$ [ml/min (normal)] | 150 | 150 | 150 | 120 |
| $H_2$ [ml/min (normal)] | 800 | 800 | — | — |
| $B_2H_6$ (ppm) (based on $SiH_4$) | — | 0.3 | 3,000 | — |
| NO [ml/min (normal)] | 10 | — | — | — |
| $CH_4$ [ml/min (normal)] | 150 | — | 150 | 600 |
| Substrate temperature: (° C.) | 260 | 275 | 240 | 240 |
| Reactor internal pressure: (Pa) | 59 | 65 | 50 | 67 |
| High-frequency power: (W) (13.56 MHz) | 300 | 300 | 350 | 300 |
| Layer thickness: (μm) | 3 | 10 (three times) | 0.5 | 0.6 |

The negative-charging photosensitive member thus produced was evaluated in the same manner as in Example 1 to obtain the results shown in Table 17.

Example 6

A negative-charging electrophotographic photosensitive member a lower-part blocking layer of which was incorporated with phosphorus was produced in the same manner as in Example 5. A lower-part blocking layer, a photoconductive layer, an upper-part blocking layer and a surface layer were deposited under conditions shown in Table 16 to produce the negative-charging electrophotographic photosensitive member the lower-part blocking layer of which was incorporated with phosphorus. Here, to form the photoconductive layer, photoconductive layer regions were deposited changing the reactor for each deposition in a thickness of 12 μm.

TABLE 16

| | Lower = part blocking layer | Photo-conductive layer | Upper = part blocking layer | Surface layer |
|---|---|---|---|---|
| Source gases and flow rates: | | | | |
| $SiH_4$ [ml/min (normal)] | 150 | 150 | 150 | 120 |
| $H_2$ [ml/min (normal)] | 800 | 800 | — | — |
| $B_2H_6$ (ppm) (based on $SiH_4$) | — | 0.3 | 3,000 | — |
| $PH_3$ (ppm) (based on $SiH_4$) | 1,000 | — | — | — |
| NO [ml/min (normal)] | 10 | — | — | — |
| $CH_4$ [ml/min (normal)] | — | — | 150 | 600 |
| Substrate temperature: (° C.) | 260 | 275 | 240 | 240 |
| Reactor internal pressure: (Pa) | 59 | 65 | 50 | 67 |
| High-frequency power: (W) (13.56 MHz) | 300 | 300 | 350 | 300 |
| Layer thickness: (μm) | 3 | 12 (three times) | 0.5 | 0.6 |

The negative-charging photosensitive member thus produced was evaluated in the same manner as in Example 1 to obtain the results shown in Table 17.

TABLE 17

| Evaluation | Example 5 | Example 6 |
|---|---|---|
| Number of protuberances: | B | B |
| Number of dots: | B | B |
| Charging performance: | C | C |
| Residual potential: | C | C |
| Potential uniformity: | C | C |
| Cost: | C | C |
| Overall evaluation: | A | A |

As can be seen from Table 17, also in the case of the negative-charging photosensitive member having a lower-part blocking layer containing P (Example 6) or the negative-charging photosensitive member having a lower-part blocking layer formed of a-Si,C,N,O:H (Example 5), the effect of the present invention can be obtained and the number of protuberances and the number of image defects dots can be extremely reduced inasmuch as the reactor is changed while the thickness of each photoconductive layer region is 3 μm or more to 15 μm or less from the support side.

Example 7

Using the VHF-CVD process production apparatus shown in FIG. 6, a lower-part blocking layer, a photoconductive layer and a surface layer were deposited on an aluminum support of 108 mm in external diameter and 5 mm in wall thickness under conditions shown in Table 18, to produce positive-charging photosensitive members. Here, to form the photoconductive layer, photoconductive layer regions were deposited changing the reactor for each deposition in a thickness of 8 μm.

TABLE 18

| | Lower = part blocking layer | Photoconductive layer | Surface layer |
|---|---|---|---|
| Source gases and flow rates: | | | |
| $SiH_4$ [ml/min (normal)] | 120 | 500 | 50 |
| $H_2$ [ml/min (normal)] | 360 | 1,000 | — |
| $B_2H_6$ (ppm) (based on $SiH_4$) | 3,000 | 0.5 | — |
| NO [ml/min (normal)] | 5 | — | — |
| $CH_4$ [ml/min (normal)] | — | — | 100 |
| Substrate temperature: (° C.) | 290 | 290 | 200 |
| Reactor internal pressure: (Pa) | 0.6 | 0.7 | 0.6 |
| High-frequency power: (W) (105 MHz) | 400 | 700 | 300 |
| Layer thickness: (μm) | 5 | 8 (four times) | 0.5 |

The positive-charging photosensitive members thus produced were evaluated in the same manner as in Example 1 to obtain the results shown in Table 20.

Example 8

Using the VHF-CVD process production apparatus shown in FIG. 6, negative-charging photosensitive members were produced in the same manner as in Example 7. A lower-part blocking layer, a photoconductive layer, an upper-part blocking layer and a surface layer were deposited on the aluminum support under conditions shown in Table 19 to produce the photosensitive members. Here, to form the photoconductive layer, photoconductive layer regions were deposited changing the reactor for each deposition in a thickness of 15 μm.

TABLE 19

| | Lower = part blocking layer | Photo-conductive layer | Upper = part blocking layer | Surface layer |
|---|---|---|---|---|
| Source gases and flow rates: | | | | |
| $SiH_4$ [ml/min(normal)] | 120 | 500 | 120 | 70 |
| $H_2$ [ml/min(normal)] | 360 | 1,000 | — | — |
| $B_2H_6$ (ppm) (based on $SiH_4$) | — | — | 1,000 | — |
| $PH_3$ (ppm) (based on $SiH_4$) | — | — | — | — |
| NO [ml/min(normal)] | 20 | — | — | — |
| $CH_4$ [ml/min(normal)] | — | — | 180 | 250 |
| Substrate temperature: (° C.) | 290 | 290 | 240 | 200 |
| Reactor internal pressure: (Pa) | 0.6 | 0.7 | 0.6 | 0.6 |
| High-frequency power: (W) (105 MHz) | 850 | 1,200 | 780 | 380 |
| Layer thickness: (μm) | 5 | 15 (three times) | 5 | 0.5 |

The negative-charging photosensitive members thus produced were evaluated in the same manner as in Example 1 to obtain the results shown in Table 20.

Comparative Example 2

Using the production apparatus shown in FIG. 6, a lower-part blocking layer, a photoconductive layer and a surface layer were deposited on an aluminum support of 108 mm in external diameter and 5 mm in wall thickness, in one reactor under the conditions shown in Table 18, provided that the operation to stop the growth of protuberances was not carried out in respect of the photoconductive layer. The positive-charging photosensitive members thus produced were evaluated in the same manner as in Example 1 to obtain the results shown in Table 20.

Comparative Example 3

Using the production apparatus shown in FIG. 6, a lower-part blocking layer, a photoconductive layer and a surface layer were deposited on an aluminum support of 108 mm in external diameter and 5 mm in wall thickness, in one reactor under the conditions shown in Table 19, provided that the operation to stop the growth of protuberances was not carried out in respect of the photoconductive layer. The positive-charging photosensitive members thus produced were evaluated in the same manner as in Example 1 to obtain the results shown in Table 20.

TABLE 20

| | Example | | Comparative Example | |
|---|---|---|---|---|
| Evaluation | 7 | 8 | 2 | 3 |
| Number of protuberances: | B | B | D | D |
| Number of dots: | B | B | D | D |
| Charging performance: | C | C | C | C |

TABLE 20-continued

| | Example | | Comparative Example | |
|---|---|---|---|---|
| Evaluation | 7 | 8 | 2 | 3 |
| Residual potential: | C | C | C | C |
| Potential uniformity: | B | B | C | C |
| Cost: | C | C | B | B |
| Overall evaluation: | A | A | D | D |

As can be seen from Table 20, also when the photosensitive members are produced by VHF-CVD in place of RF-CVD, the effect of the present invention can be obtained and the number of protuberances and the number of image defects, dots, can be extremely reduced inasmuch as the reactor is changed while the thickness of each photoconductive layer region is 3 μm or more to 15 μm or less from the support side.

Example 9

In Example 9, using the production system shown in FIG. 10, the transporting vacuum chamber was used when the reactor was changed in the course of forming the photoconductive layer. For the others, the same procedures as in Example 4 were repeated under the conditions shown in Table 21, to deposit a lower-part blocking layer, a photoconductive layer and a surface layer on the aluminum support to produce a positive-charging photosensitive member. Here, to form the photoconductive layer, photoconductive layer regions were deposited changing the reactor for each deposition in a thickness of 10 μm.

TABLE 21

| | | Photoconductive layer | | |
|---|---|---|---|---|
| | Lower = part blocking layer | Photo-conductive layer region | Photo-conductive layer region | Surface layer |
| Source gases and flow rates: | | | | |
| $SiH_4$ [ml/min (normal)] | 350 | 450 | 180 | 250→30→12 |
| $H_2$ [ml/min (normal)] | 700 | 2,000 | 1,500 | — |
| $B_2H_6$ (ppm) (based on $SiH_4$) | 2,000 | 0.2 | — | — |
| NO [ml/min (normal)] | 40 | — | — | — |
| $CH_4$ [ml/min (normal)] | — | — | — | 5→60→600 |
| Substrate temperature: (° C.) | 260 | 275 | 260 | 240 |
| Reactor internal pressure: (Pa) | 55 | 65 | 58 | 44 |
| High-frequency power: (W) (13.56 MHz) | 350 | 800 | 250 | 400 |
| Layer thickness: (μm) | 2 | 10 (twice) | 10 (once) | 0.6 |

The positive-charging photosensitive member thus produced was evaluated in the same manner as in Example 1 to obtain the results shown in Table 23.

Example 10

Using the production system shown in FIG. 10, the support on which a layer region was deposited was moved to the transporting vacuum chamber when the reactor was changed in the course of forming the photoconductive layer. In the meantime, the reactor having been used in the deposition was cleaned, and after it was brought into a clean condition, the support under deposition was moved thereto from the transporting vacuum chamber, where a further photoconductive layer region was deposited. For the others, the same procedure as in Example 3 was repeated under the conditions shown in Table 22, to deposit a lower-part blocking layer, a photoconductive layer and a surface layer on the aluminum support to produce a positive-charging photosensitive member. Here, to form the photoconductive layer, photoconductive layer regions were deposited changing the reactor for each deposition in a thickness of 10 μm.

TABLE 22

| | Lower = part blocking layer | Photo conductive layer | Surface layer |
|---|---|---|---|
| Source gases and flow rates: | | | |
| $SiH_4$ [ml/min (normal)] | 350 | 450 | 250→30→12 |
| $H_2$ [ml/min (normal)] | 700 | 2,000 | — |
| $B_2H_6$ (ppm) (based on $SiH_4$) | 2,000 | 0.2 | — |
| NO [ml/min (normal)] | 40 | — | — |
| $CH_4$ [ml/min (normal)] | — | — | 5→60→600 |
| Substrate temperature: (° C.) | 260 | 275 | 240 |
| Reactor internal pressure: (Pa) | 55 | 65 | 44 |
| High-frequency power: (W) (13.56 MHz) | 350 | 800 | 400 |
| Layer thickness: (μm) | 2 | 10 (three times) | 0.6 |

The positive-charging photosensitive member thus produced was evaluated in the same manner as in Example 1 to obtain the results shown in Table 23.

TABLE 23

| Evaluation | Example 9 | Example 10 |
|---|---|---|
| Number of protuberances: | B | A |
| Number of dots: | A | A |
| Charging performance: | C | C |
| Residual potential: | C | C |
| Potential uniformity: | C | C |
| Cost: | C | C |
| Overall evaluation: | A | A |

As can be seen from Table 23, also when the photosensitive members are produced by the production system making use of the transporting vacuum chamber and also when the photosensitive members are produced using the reactor having been cleaned, the effect of the present invention can be obtained and the number of protuberances and the number of image defects dots can be extremely reduced in as much as the reactor is changed while the thickness of each photoconductive layer region is 3 μm or more to 15 μm or less from the support side.

Example 11

Using the production system shown in FIG. 10, the transporting vacuum chamber was used when the reactor was changed in the course of forming the photoconductive layer.

In Example 11, the support under deposition was set in the reactor, and then the surface of the photoconductive layer region was subjected to treatment with hydrogen plasma under conditions shown in Table 25. Then the deposition of a photoconductive layer region was again started. Except this, the procedure of Example 4 was repeated but under conditions shown in Table 24, to deposit a lower-part blocking layer, a photoconductive layer and a surface layer on the aluminum support to produce a positive-charging photosensitive member. Here, to form the photoconductive layer, photoconductive layer regions were deposited changing the reactor for each deposition in a thickness of 10 μm.

TABLE 24

| | | Photoconductive layer | | |
|---|---|---|---|---|
| | Lower = part blocking layer | Photo-conductive layer region | Photo-conductive layer region | Surface layer |
| Source gases and flow rates: | | | | |
| $SiH_4$ [ml/min (normal)] | 350 | 450 | 180 | 250→30→12 |
| $H_2$ [ml/min (normal)] | 700 | 2,000 | 1,500 | — |
| $B_2H_6$ (ppm) (based on $SiH_4$) | 2,000 | 0.2 | — | — |
| NO [ml/min (normal)] | 40 | — | — | — |
| $CH_4$ [ml/min (normal)] | — | — | — | 5→60→600 |
| Substrate temperature: (° C.) | 260 | 275 | 260 | 240 |
| Reactor internal pressure: (Pa) | 55 | 65 | 58 | 44 |
| High-frequency power: (W) (13.56 MHz) | 350 | 800 | 250 | 400 |
| Layer thickness: (μm) | 2 | 10 (twice) | 10 (once) | 0.6 |

TABLE 25

| | |
|---|---|
| Treatment: $H_2$ [ml/min (normal)] | 1,000 |
| Support temperature: (° C.) | 200 |
| Reactor internal pressure: (Pa) | 50 |
| High-frequency power: (W) | 500 |
| Treatment time: (second) | 180 |

The positive-charging photosensitive member thus produced was evaluated in the same manner as in Example 1 to obtain the results shown in Table 27.

Example 12

Using the production system shown in FIG. 10, the transporting vacuum chamber was used when the reactor was changed in the course of forming the photoconductive layer.

In Example 12, the support under deposition was set in the reactor, and then the support on which a photoconductive layer region was deposited was heated and kept at 300° C. for 120 minutes to tarry out heat treatment, which was returned to a stated temperature, and the deposition of a photoconductive layer region was started again. For the others, the same procedure as in Example 4 was repeated under conditions shown in Table 26, to deposit a lower-part blocking layer, a photoconductive layer and a surface layer on the aluminum support to produce a positive-charging photosensitive member. Here, to form the photoconductive layer, photoconductive layer regions were deposited changing the reactor for each deposition in a thickness of 10 μm.

TABLE 26

| | Lower = part blocking layer | Photoconductive layer: Photo-conductive layer region | Photoconductive layer: Photo-conductive layer region | Surface layer |
|---|---|---|---|---|
| Source gases and flow rates: | | | | |
| $SiH_4$ [ml/min (normal)] | 100 | 250 | 150 | 250→30→12 |
| $H_2$ [ml/min (normal)] | 700 | 2,000 | 600 | — |
| $B_2H_6$ (ppm) (based on $SiH_4$) | 1,500 | 0.1 | — | — |
| NO [ml/min (normal)] | 10 | — | — | — |
| $CH_4$ [ml/min (normal)] | — | — | — | 5→60→600 |
| Substrate temperature: (° C.) | 290 | 280 | 260 | 240 |
| Reactor internal pressure: (Pa) | 55 | 60 | 58 | 44 |
| High-frequency power: (W) (13.56 MHz) | 150 | 600 | 150 | 400 |
| Layer thickness: (μm) | 4 | 10 (twice) | 10 (once) | 0.6 |

The positive-charging photosensitive member thus produced was evaluated in the same manner as in Example 1 to obtain the results shown in Table 27.

TABLE 27

| Evaluation | Example 11 | Example 12 |
|---|---|---|
| Number of protuberances: | B | B |
| Number of dots: | A | A |
| Charging performance: | B | B |
| Residual potential: | B | B |
| Potential uniformity: | C | B |
| Cost: | C | C |
| Overall evaluation: | A | A |

As can be seen from Table 27, the plasma treatment brings an improvement in electrical bond properties of layers, and improvements are seen in respect of charging performance and residual potential. The heat treatment of the photosensitive member on the way of deposition has promoted relaxation of film structures to bring an improvement in potential characteristics.

As can further be seen therefrom, the number of protuberances and the number of image defects dots can be extremely reduced inasmuch as the reactor is changed while the thickness of each photoconductive layer region is 3 μm or more to 15 μm or less from the support side.

Example 13

Using the production apparatus shown in FIG. 5, layers were deposited on an aluminum support of 80 mm in external diameter, 358 mm in length and 3 mm in wall thickness to produce a negative-charging photosensitive member a lower-part blocking layer of which was incorporated with phosphorus. A lower-part blocking layer, a photoconductive layer, an upper-part blocking layer and a surface layer were deposited under conditions shown in Table 28. Here, to form the photoconductive layer, photoconductive layer regions were deposited changing the reactor for each deposition in a thickness of 9 μm.

TABLE 28

| | Lower = part blocking layer | Photo-conductive layer | Upper = part blocking layer | Surface layer |
|---|---|---|---|---|
| Source gases and flow rates: | | | | |
| $SiH_4$ [ml/min (normal)] | 150 | 150 | 150 | 120 |
| $H_2$ [ml/min (normal)] | 800 | 800 | — | — |
| $B_2H_6$ (ppm) (based on $SiH_4$) | — | 0.3 | 3,000 | — |
| $PH_3$ (ppm) (based on $SiH_4$) | 1,000 | — | — | — |
| NO [ml/min (normal)] | 10 | — | — | — |
| $CH_4$ [ml/min (normal)] | — | — | 150 | 600 |
| Substrate temperature: (° C.) | 260 | 275 | 240 | 240 |
| Reactor internal pressure: (Pa) | 59 | 65 | 50 | 67 |
| High-frequency power: (W) (13.56 MHz) | 300 | 300 | 350 | 300 |
| Layer thickness: (μm) | 3 | 9 (four times) | 0.5 | 0.6 |

The negative-charging photosensitive member thus produced was evaluated in the same manner as in Example 1 except that a full-color electrophotographic apparatus adjusted to be usable for a-Si electrophotographic photosensitive members was used, which was PIXEL CLC-500, manufactured by CANON INC., whose charging system and developing system were remodeled. The results are shown in Table 30.

Example 14

As with Example 13, using the production apparatus shown in FIG. 5, layers were deposited on an aluminum support of 80 mm in external diameter, 358 mm in length and 3 mm in wall thickness to produce a negative-charging photosensitive member a lower-part blocking layer of which was incorporated with carbon. A lower-part blocking layer, a photoconductive layer, an upper-part blocking layer and a surface layer were deposited under conditions shown in Table 29. Here, to form the photoconductive layer, photoconductive layer regions were deposited changing the reactor for each deposition in a thickness of 10 μm.

TABLE 29

| | Lower = part blocking layer | Photo-conductive layer | Upper = part blocking layer | Surface layer |
|---|---|---|---|---|
| Source gases and flow rates: | | | | |
| $SiH_4$ [ml/min (normal)] | 200 | 350 | 200 | 50 |
| $H_2$ [ml/min (normal)] | 800 | 1,400 | — | — |
| $B_2H_6$ (ppm) (based on $SiH_4$) | — | — | 300 | — |
| NO [ml/min (normal)] | 10 | — | — | — |

TABLE 29-continued

| | Lower = part blocking layer | Photo-conductive layer | Upper = part blocking layer | Surface layer |
|---|---|---|---|---|
| $CH_4$ [ml/min (normal)] | 500 | — | 350 | 800 |
| Substrate temperature: (° C.) | 290 | 280 | 270 | 240 |
| Reactor internal pressure: (Pa) | 55 | 58 | 50 | 63 |
| High-frequency power: (W) (13.56 MHz) | 250 | 650 | 350 | 280 |
| Layer thickness: (μm) | 3 | 10 (three times) | 0.2 | 0.6 |

Evaluation was made in the same manner as in Example 1, using CLC-500. The results are shown in Table 30.

TABLE 30

| Evaluation | Example 13 | Example 14 |
|---|---|---|
| Number of protuberances: | B | B |
| Number of dots: | B | A |
| Charging performance: | B | B |
| Residual potential: | C | C |
| Potential uniformity: | C | C |
| Cost: | C | B |
| Overall evaluation: | A | A |

As can be seen from Table 30, also in the case of the negative-charging photosensitive member or the negative-charging photosensitive member having a lower-part blocking layer formed of a-Si,C,N,O:H, the number of protuberances and the number of image defects, dots, can be extremely reduced inasmuch as the reactor is changed while the thickness of each photoconductive layer region is 3 μm or more to 15 μm or less from the support side. High-quality full-color images can be obtained by using such negative-charging photosensitive members in full-color electrophotographic apparatus.

As described above, according to the process of the present invention, for example, the following steps are carried out: a step of placing a cylindrical support in a reactor having an evacuation means and a source gas feed means and capable of being made vacuum-airtight, and decomposing at least a source gas by means of a high-frequency power to deposit on the support a photoconductive layer formed of at least a non-single-crystal material, a step of taking out of the reactor the cylindrical support on which a photoconductive layer region has been deposited to move it to a different reactor, and a step of decomposing in the different reactor at least a source gas by means of a high-frequency power to carry out deposition until a photoconductive layer comes to have a stated layer thickness; thereby forming in the photoconductive layer the portions where the protuberances have been stopped from growing and making the protuberances not larger than the size in which they may appear on images. As a result, it has been made possible to provide an electrophotographic photosensitive member in which image defects have vastly been remedied. It has also been made possible to provide an electrophotographic photosensitive member production process that can vastly remedy the image defects.

Besides, electrical bond properties of layers are improved by carrying out hydrogen plasma treatment before the deposition of a photoconductive layer region is started again, achieving an improvement in electrical properties.

Moreover, the heat treatment carried out before restarting the deposition of a photoconductive layer region can promote relaxation of film structures to achieve an improvement in the distribution of electrical characteristics.

What is claimed is:

1. An electrophotographic photosensitive member comprising a support, at least the surface of which is conductive, and a photoconductive layer formed thereon containing an amorphous material composed chiefly of silicon, wherein;

said photoconductive layer has two or more layer regions, and protuberances in a layer region (A) adjoining to a layer region (B) that is closest to a free surface of the electrophotographic photosensitive member have been stopped from growing at the surface of the layer region (A), and said layer regions each have a layer thickness of from 3 μm to 15 μm, wherein, at the surface of a layer region of said photoconductive layer, protuberances of 15 μm or more each in major axis are in a number of 5 or less per 100 $cm^2$.

2. An electrophotographic photosensitive member according to claim 1, wherein said photoconductive layer has a layer thickness of from 10 μm to 60 μm.

3. An electrophotographic photosensitive member according to claim 1, wherein said layer regions are present in a number of from 2 to 6 in the layer thickness direction.

4. An electrophotographic photosensitive member according to claim 1, wherein at least a blocking layer and the photoconductive layer are superposingly formed in this order on said support.

5. An electrophotographic photosensitive member according to claim 1, wherein a surface protective layer is provided.

6. An electrophotographic photosensitive member according to claim 1, wherein a blocking layer and a surface protective layer are superposingly formed on said photoconductive layer.

7. A process for producing an electrophotographic photosensitive member having a support, at least the surface of which is conductive, and a photoconductive layer formed thereon containing an amorphous material composed chiefly of silicon, which comprises forming the surface of the layer region (A) in the photoconductive layer, carrying out an operation for stopping protuberances from growing at the surface of the layer region (A), and forming a layer region (B) on the layer region (A), wherein;

said photoconductive layer has two or more layer regions, and protuberances in the layer region (A) adjoining to the layer region (B) that is closest to a free surface of the electrophotographic photosensitive member have been stopped from growing at the surface of the layer region (A), and said operation is carried out while the thickness of each photoconductive layer region comes to be 3 μm or more to 15 μm or less from the support side, wherein said operation is carried out by taking out of a reaction chamber the support on which a layer region of said photoconductive layer has been formed to move it to a different reactor.

8. A process for producing an electrophotographic photosensitive member according to claim 7, wherein said support is taken out of the reaction chamber into a vacuum atmosphere.

9. A process for producing an electrophotographic photosensitive member according to claim 7, wherein the deposition of said photoconductive layer region is repeated a plurality of times to form the photoconductive layer.

10. A process for producing an electrophotographic photosensitive member having a support, at least the surface of which is conductive, and a photoconductive layer formed thereon containing an amorphous material composed chiefly of silicon, which comprises forming the surface of the layer region (A) in the photoconductive layer, carrying out an operation for stopping protuberances from growing at the surface of the layer region (A), and forming a layer region (B) on the layer region (A), wherein:

said photoconductive layer has two or more layer regions, and protuberances in the layer region (A) adjoining to the layer region (B) that is closest to a free surface of the electrophotographic photosensitive member have been stopped from growing at the surface of the layer region (A), and said operation is carried out while the thickness of each photoconductive layer region comes to be 3 μm or more to 15 μm or less from the support side, wherein the photoconductive layer is formed using a support-loading vacuum chamber, a support-heating vacuum chamber, a reaction vacuum chamber, a support-cooling and -delivery vacuum chamber and a transporting vacuum chamber; the transporting vacuum chamber is moved between the support-loading vacuum chamber and each of the said other vacuum chambers, and connected with the support-loading vacuum chamber and each of the said vacuum chambers via their open-close gates, so that the support can be taken in and out of, and moved between, the transporting vacuum chamber and the support-loading vacuum chamber and the said other vacuum chambers, where; a photoconductive layer region containing an amorphous material composed chiefly of silicon is formed on the support set in the reaction vacuum chamber, and thereafter the support on which the photoconductive layer region has been deposited is transported to, and set in, a different reaction chamber by means of the transporting vacuum chamber to repeat deposition of a photoconductive layer region containing an amorphous material composed chiefly of silicon.

11. A process for producing an electrophotographic photosensitive member according to claim 10, wherein said transporting vacuum chamber comprises a transporting vacuum chamber which transports the support from the support-loading chamber to the reaction chamber, a transporting vacuum chamber which transports the support with a photoconductive layer region from the reaction chamber to the same or different reaction chamber, and a transporting vacuum chamber which transports the support with photoconductive layer regions from the reaction chamber to the support-delivery chamber.

12. A process for producing an electrophotographic photosensitive member according to claim 10, wherein the support on which a photoconductive layer region has been deposited is transported to a reaction chamber whose inner surfaces have been cleaned, and another photoconductive layer region is superposingly formed thereon.

13. A process for producing an electrophotographic photosensitive member according to claim 10, wherein said photoconductive layer region deposited in one reaction chamber is in a layer thickness of from 3 μm to 15 μm.

14. A process for producing an electrophotographic photosensitive member having a support, at least the surface of which is conductive, and a photoconductive layer formed thereon containing an amorphous material composed chiefly of silicon, which comprises forming the surface of the layer region (A) in the photoconductive layer, carrying out an operation for stopping protuberances from growing at the surface of the layer region (A), and forming a layer region (B) on the layer region (A), wherein:

said photoconductive layer has two or more layer regions, and protuberances in the layer region (A) adjoining to the layer region (B) that is closest to a free surface of the electrophotographic photosensitive member have been stopped from growing at the surface of the layer region (A), and said operation is carried out while the thickness of each photoconductive layer region comes to be 3 μm or more to 15 μm or less from the support side, wherein a photoconductive layer region is superposingly formed after the surface of a photoconductive layer region deposited previously has been treated with hydrogen plasma.

* * * * *

UNITED STATES PATENT AND TRADEMARK OFFICE

CERTIFICATE OF CORRECTION

PATENT NO. : 7,338,738 B2
APPLICATION NO. : 10/733568
DATED : March 4, 2008
INVENTOR(S) : Satoshi Kojima et al.

It is certified that error appears in the above-identified patent and that said Letters Patent is hereby corrected as shown below:

COLUMN 13:

Line 45, “SO” should read --so--.

COLUMN 17:

Table 2, “Lower=part” should read --Lower-part--.

COLUMN 18:

Table 3, “Photoconductive=layer” should read --Photoconductive-layer--.
Table 6, “Photoconductive=layer” should read --Photoconductive-layer--.

COLUMN 19:

Table 6, “Photoconductive=layer” should read --Photoconductive-layer--.

COLUMN 21:

Table 7, “Lower=part” should read --Lower-part--.

COLUMN 22:

Table 9, “Lower=part” should read --Lower-part--.
Table 10, “Photoconductive=layer” should read --Photoconductive-layer--.

COLUMN 23:

Table 12, “Lower=part” should read --Lower-part--.

COLUMN 24:

Table 13, “Lower=part” should read --Lower-part--.

UNITED STATES PATENT AND TRADEMARK OFFICE

CERTIFICATE OF CORRECTION

PATENT NO. : 7,338,738 B2
APPLICATION NO. : 10/733568
DATED : March 4, 2008
INVENTOR(S) : Satoshi Kojima et al.

It is certified that error appears in the above-identified patent and that said Letters Patent is hereby corrected as shown below:

COLUMN 25:

Table 15, “Lower=part” should read --Lower-part-- and “Upper=part” should read --Upper-part--.
Table 16, “Lower=part” should read --Lower-part-- and “Upper=part” should read --Upper-part--.

COLUMN 26:

Table 18, “Lower=part” should read --Lower-part--.

COLUMN 27:

Table 19, “Lower=part” should read --Lower-part-- and “Upper=part” should read --Upper-part--.

COLUMN 28:

Table 21, “Lower=part” should read --Lower-part--.

COLUMN 29:

Table 22, “Lower=part” should read --Lower-part--.

COLUMN 30:

Table 24, “Lower=part” should read --Lower-part--.
Line 64, “tarry” should read --carry--.

COLUMN 31:

Table 26, “Lower=part” should read --Lower-part--.

UNITED STATES PATENT AND TRADEMARK OFFICE

CERTIFICATE OF CORRECTION

PATENT NO. : 7,338,738 B2
APPLICATION NO. : 10/733568
DATED : March 4, 2008
INVENTOR(S) : Satoshi Kojima et al.

It is certified that error appears in the above-identified patent and that said Letters Patent is hereby corrected as shown below:

COLUMN 32:

Table 28, “Lower=part” should read --Lower-part-- and “Upper=part” should read --Upper-part--.
Table 29, “Lower=part” should read --Lower-part-- and “Upper=part” should read --Upper-part--.

COLUMN 33:

Table 29, “Lower=part” should read --Lower-part-- and “Upper=part” should read --Upper-part--.

Signed and Sealed this

Twenty-fourth Day of March, 2009

JOHN DOLL
*Acting Director of the United States Patent and Trademark Office*